US010987693B2

(12) United States Patent
Pringle, IV et al.

(10) Patent No.: US 10,987,693 B2
(45) Date of Patent: Apr. 27, 2021

(54) SEALANT APPLICATION TIP

(71) Applicant: The Boeing Company, Chicago, IL (US)

(72) Inventors: John Walter Pringle, IV, Gardena, CA (US); Chris J. Erickson, Garden Grove, CA (US); Martin Hanna Guirguis, Long Beach, CA (US); Angelica Davancens, Reseda, CA (US); Frederick B. Frontiera, Mt. Pleasant, SC (US)

(73) Assignee: The Boeing Company, Chicago, IL (US)

( * ) Notice: Subject to any disclaimer, the term of this patent is extended or adjusted under 35 U.S.C. 154(b) by 282 days.

(21) Appl. No.: 14/828,794

(22) Filed: Aug. 18, 2015

(65) Prior Publication Data

US 2017/0050213 A1 Feb. 23, 2017

(51) Int. Cl.

| | |
|---|---|
| ***B05C 5/02*** | (2006.01) |
| ***B05C 11/10*** | (2006.01) |
| ***B05B 15/65*** | (2018.01) |
| ***B05C 1/02*** | (2006.01) |
| ***B05B 1/30*** | (2006.01) |
| *B05B 11/00* | (2006.01) |

(52) U.S. Cl.

CPC ..... *B05C 5/0216* (2013.01); *B05B 1/30* (2013.01); *B05B 15/65* (2018.02); *B05C 1/027* (2013.01); *B05C 11/1021* (2013.01); *B05B 11/001* (2013.01); *B05C 11/1044* (2013.01)

(58) Field of Classification Search

CPC ..... B05B 1/30; B05B 13/04–0457; B05B 11/001; B05B 15/65; B05C 1/027

See application file for complete search history.

(56) References Cited

U.S. PATENT DOCUMENTS

| | | | | |
|---|---|---|---|---|
| 4,295,828 | A | 10/1981 | Rudler | |
| 4,698,005 | A * | 10/1987 | Kikuchi | B05B 13/0431 118/206 |
| 4,945,593 | A | 8/1990 | Giebel et al. | |
| 5,373,973 | A * | 12/1994 | Foster | B05B 9/0426 222/324 |
| 6,986,472 | B2 * | 1/2006 | Gordon | B05C 5/0216 222/529 |
| 8,651,046 | B1 | 2/2014 | Davancens et al. | |
| 9,016,530 | B2 | 4/2015 | Topf et al. | |

(Continued)

FOREIGN PATENT DOCUMENTS

| | | | |
|---|---|---|---|
| CN | 202427604 | U | 9/2012 |
| DE | 202007019244 | U1 | 8/2011 |

(Continued)

OTHER PUBLICATIONS

"Cartridge Nozzles from Adhesive Dispensing Techcon Semco," Adhesive Dispensing Ltd., copyright 2015, 5 pages, accessed Aug. 11, 2015. http://www.adhesivedispensing.co.uk/cartridgenozzles29c.asp.

(Continued)

*Primary Examiner* — Dah-Wei D. Yuan
*Assistant Examiner* — Stephen A Kitt
(74) *Attorney, Agent, or Firm* — Yee & Associates, P.C.

(57) ABSTRACT

A method and apparatus for applying a sealant to a structure. The method comprises scanning a surface of the structure with a vision system to form scanned data. The method further determines a sealant application path for the structure using the scanned data. The method also controls movement of an application tip along the sealant application path using a controller.

39 Claims, 20 Drawing Sheets

(56) References Cited

U.S. PATENT DOCUMENTS

| | | | | |
|---|---|---|---|---|
| 2002/0132038 | A1 | 9/2002 | Birmingham | |
| 2003/0129317 | A1* | 7/2003 | Hynes | B05B 13/0421 427/98.4 |
| 2004/0170756 | A1* | 9/2004 | Machida | B05C 5/0216 427/115 |
| 2006/0081807 | A1* | 4/2006 | Browne | F16K 7/12 251/331 |
| 2007/0000442 | A1 | 1/2007 | Schucker | |
| 2007/0102484 | A1 | 5/2007 | Baldwin | |
| 2011/0282492 | A1 | 11/2011 | Krause et al. | |
| 2014/0079871 | A1 | 3/2014 | Lu et al. | |
| 2014/0242291 | A1 | 8/2014 | Joos et al. | |
| 2015/0044376 | A1 | 2/2015 | Topf et al. | |
| 2015/0053787 | A1 | 2/2015 | Tomuta et al. | |
| 2015/0064357 | A1 | 3/2015 | Romuta et al. | |

FOREIGN PATENT DOCUMENTS

| | | | |
|---|---|---|---|
| EP | 2254705 | B1 | 11/2012 |
| EP | 2896463 | A1 | 7/2015 |
| EP | 3072598 | B1 | 3/2019 |
| GB | 2166066 | B | 7/1988 |

OTHER PUBLICATIONS

Intellectual Property Office Combined Search and Examination Report, dated Nov. 30, 2016, regarding Application No. GB1613694.7, 9 pages.

Intellectual Property Office of Great Britain Examination Report, dated Feb. 12, 2019, regarding Application No. GB1613694.7, 5 pages.

Intellectual Property Office of Great Britain Examination Report, dated Nov. 29, 2018, regarding Application No. GB1613694.7, 4 pages.

Intellectual Property Office of Great Britain Search and Examination Report, dated Dec. 18, 2019, regarding Application No. GB1916774.1, 9 pages.

Intellectual Property Office of Great Britain Examination Report, dated Jan. 29, 2020, regarding Application No. GB1916774.1, 3 pages.

* cited by examiner

SEALANT APPLICATION TIP

BACKGROUND INFORMATION

1. Field

The present disclosure relates generally to sealing and, in particular, to applying sealant. More particularly, the present disclosure relates to a method and apparatus for applying sealant using a sealant application tip.

2. Background

Seals may be used to block fluids from passing through joints between components. A seal may be formed by applying sealant to a joint. A seal may not only have desired material properties, but also a desired shape.

Currently, an operator may perform a series of steps to prepare a structure, apply the sealant to the structure, and shape the sealant. For example, an operator may mask the structure prior to applying the sealant. After applying the sealant, the operator may then manually shape the sealant using a spatula.

An operator performing multiple steps may take an undesirable amount of time. Further, an operator performing multiple steps may use an undesirable amount of labor. Yet further, a manually shaped sealant may have a higher likelihood of shape deviations. A manually shaped sealant bead may have undesirable quality.

Some structures may have complex geometries. Complex geometries, such as fasteners, may impinge into a sealant application path. When complex geometries impinge into a sealant application path, it may be more difficult than desired to apply sealant to the structure.

Therefore, it would be desirable to have a method and apparatus that take into account at least some of the issues discussed above, as well as other possible issues. For example, it may be desirable for a sealant shape to be repeatable and consistent. Yet further, it may be desirable to reduce an amount of time to form a seal.

SUMMARY

In an illustrative embodiment, a method of applying sealant to a structure may be provided. The method may comprise scanning a surface of the structure with a vision system to form scanned data. The method may further determine a sealant application path for the structure using the scanned data. The method may also control movement of an application tip along the sealant application path using a controller.

A further illustrative embodiment of the present disclosure may provide a sealing system. The sealing system may comprise a tool, a controller, and an application tip. The tool has a nozzle and a sealant source. The controller controls movement of the tool and flow of a sealant from the sealant source. The application tip is connected to the nozzle of the tool for applying the sealant to a structure.

A yet further illustrative embodiment of the present disclosure may provide a sealing system. The sealing system may comprise an application tip and a controller. The application tip comprises a housing with a first end and a second end opposite the first end and a channel extending through the housing from the first end and the second end. The first end may have a number of connections to interface with a nozzle of a tool. The second end may have at least one of a guide surface, a sealant surface, or a forming surface.

The guide surface may be configured to contact a first surface of a structure as the application tip moves relative to the structure. The sealant surface may be configured to contact a second surface of the structure as the application tip moves relative to the structure. The forming surface may be configured to form an exterior shape of a sealant as the application tip deposits the sealant. The controller may control movement of the application tip relative to the structure to apply the sealant.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1:
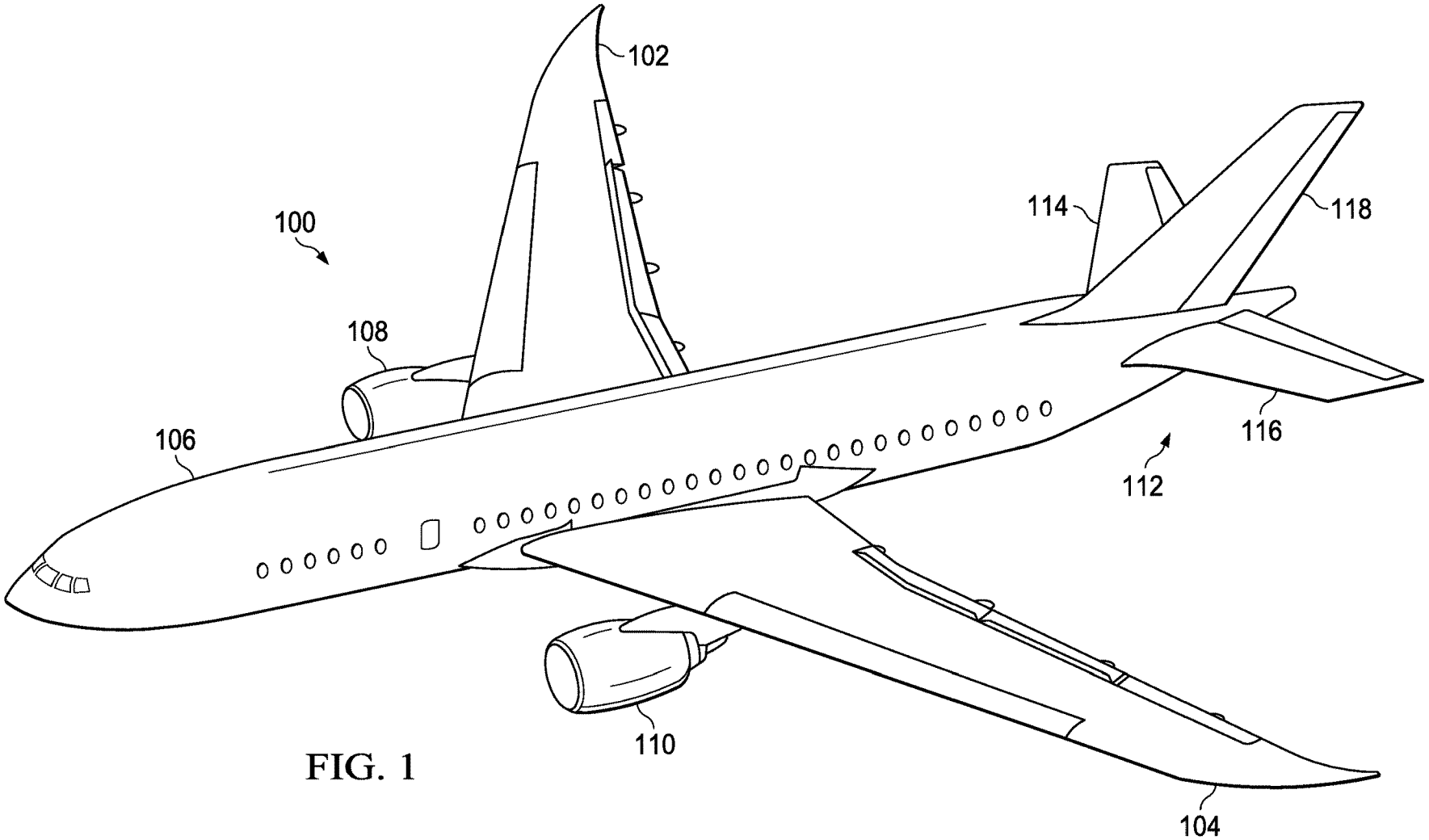
FIG. 1 is an illustration of an aircraft in which an illustrative embodiment may be implemented.

With reference now to the figures, and in particular, with reference to FIG. 1, an illustration of an aircraft is depicted in which an illustrative embodiment may be implemented. In this illustrative example, aircraft 100 has wing 102 and wing 104 attached to body 106. Aircraft 100 includes engine 108 attached to wing 102 and engine 110 attached to wing 104. Body 106 has tail section 112. Horizontal stabilizer 114, horizontal stabilizer 116, and vertical stabilizer 118 are attached to tail section 112 of body 106.

Aircraft 100 is an example of an aircraft having joints in which sealant may be applied using an application tip in accordance with an illustrative embodiment. For example, an access panel in either wing 102 or wing 104 may have a nut panel with a seal. A seal in an access panel may be formed by applying a sealant using an application tip.

This illustration of aircraft 100 is provided for purposes of illustrating one environment in which the different illustrative embodiments may be implemented. The illustration of aircraft 100 in FIG. 1 is not meant to imply architectural limitations as to the manner in which different illustrative embodiments may be implemented. For example, aircraft 100 is shown as a commercial passenger aircraft. The different illustrative embodiments may be applied to other types of aircraft, such as a private passenger aircraft, a rotorcraft, and other suitable type of aircraft.

Figure 2:
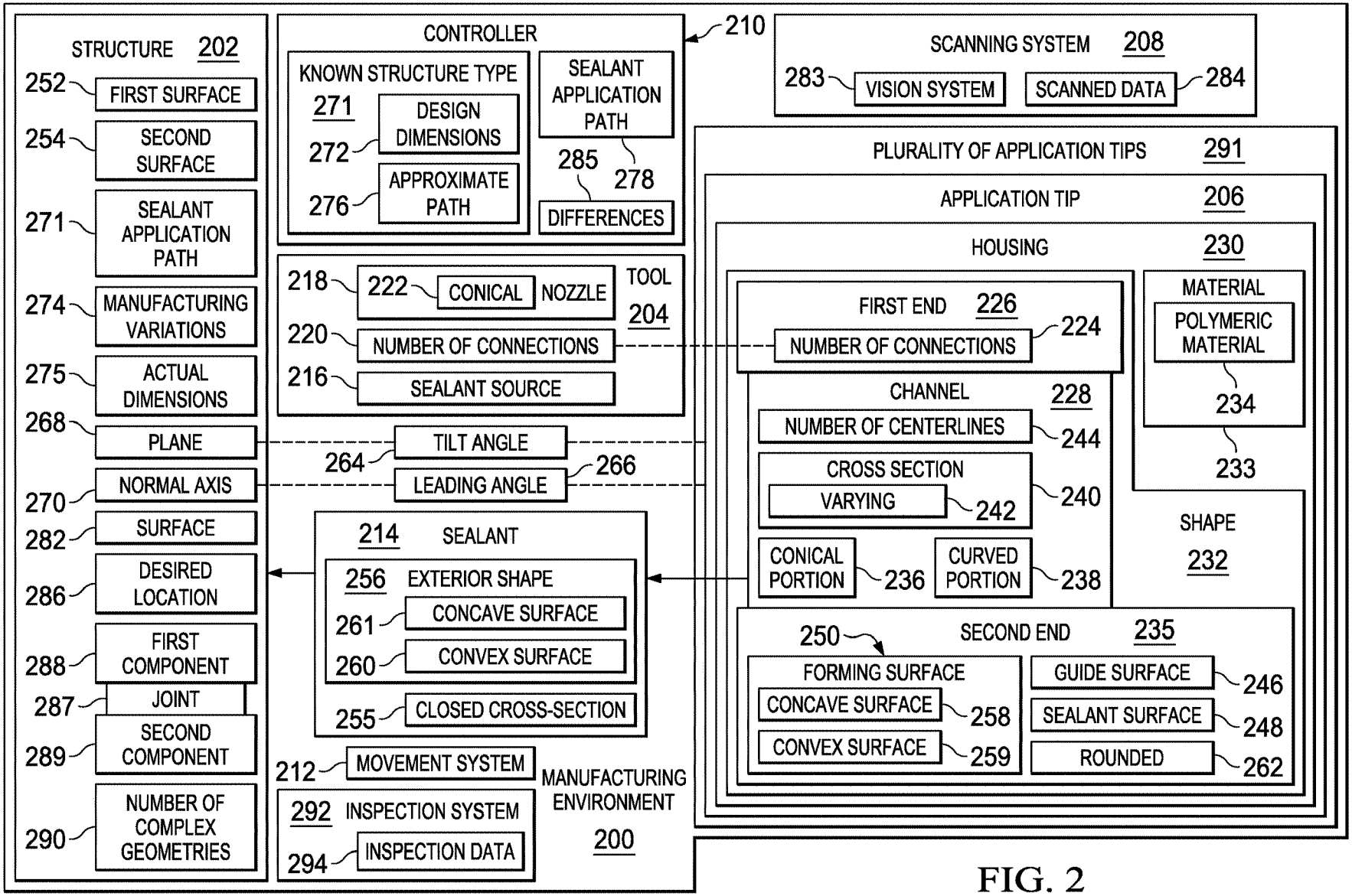
FIG. 2 is an illustration of a block diagram of a manufacturing environment in accordance with an illustrative embodiment.

Turning now to FIG. 2, an illustration of a block diagram of a manufacturing environment is depicted in accordance with an illustrative embodiment. Manufacturing environment 200 may be used to apply a sealant to a component of aircraft 100.

Manufacturing environment 200 includes structure 202, tool 204, application tip 206, scanning system 208, controller 210, and movement system 212. Tool 204 and application tip 206 may be used to apply sealant 214 to structure 202. Sealant 214 may be supplied by sealant source 216 of tool 204. Tool 204 may also include nozzle 218 and number of connections 220. As used herein, a "number of" items may include one or more items. In this manner, number of connections 220 means one or more connections. In some examples, nozzle 218 may be conical 222.

Application tip 206 may interface with nozzle 218. Application tip 206 may be placed relative to nozzle 218 and connected to tool 204 using number of connections 220 and number of connections 224. Number of connections 224 of first end 226 of application tip 206 may interface with number of connections 220 to connect application tip 206 to tool 204.

When application tip 206 is connected to tool 204, sealant 214 may flow from sealant source 216 through nozzle 218 and into application tip 206. Sealant 214 may then flow through application tip 206 to structure 202. More specifically, sealant 214 may flow through channel 228 of application tip 206.

Application tip 206 may have housing 230 through which channel 228 extends. Housing 230 may have shape 232. Shape 232 may be influenced by an intended use, a desirable weight for application tip 206, a desirable cost for application tip 206, the shape of tool 204, characteristics of structure 202, or any other desirable characteristic.

Housing 230 may be formed of material 233. Material 233 may be selected based on at least one of cost, machinability, manufacturability, melting point, weight, surface wettability, interaction with sealant 214, or other desirable characteristic. As used herein, the phrase "at least one of," when used with a list of items, means different combinations of one or more of the listed items may be used and only one of each item in the list may be needed. In other words, "at least one of" means any combination of items and number of items may be used from the list, but not all of the items in the list are required. The item may be a particular object, thing, or a category.

For example, "at least one of item A, item B, or item C" may include, without limitation, item A, item A and item B, or item B. This example also may include item A, item B, and item C or item B and item C. Of course, any combinations of these items may be present. In other examples, "at least one of" may be, for example, without limitation, two of item A; one of item B; and ten of item C; four of item B and seven of item C; or other suitable combinations.

In some illustrative examples, material 233 may be selected such that it may be injection molded. In some illustrative examples, material 233 may take the form of polymeric material 234.

Housing 230 may have first end 226 and second end 235 opposite of first end 226. Shape 232 may include both first end 226 and second end 235. Channel 228 may extend through housing 230 from first end 226 to second end 235. First end 226 has number of connections 224 to interface with nozzle 218 of tool 204. Channel 228 may have conical portion 236 that is complementary to nozzle 218 when nozzle 218 is conical 222. Channel 228 may also have curved portion 238.

Channel 228 may have cross-section 240. In some illustrative examples, cross-section 240 may be varying 242. In these illustrative examples, cross-section 240 may be referred to as a varying cross-section. For example, when channel 228 includes both conical portion 236 and curved portion 238, cross-section 240 is varying 242.

Channel 228 may have number of centerlines 244. In some illustrative examples, number of centerlines 244 may only be one centerline. In some other illustrative examples, number of centerlines 244 may be more than one centerline. For example, when channel 228 includes both conical portion 236 and curved portion 238, channel 228 may include more than one centerline.

Cross-section 240 and number of centerlines 244 of channel 228 may be selected such that a desired amount of sealant 214 is provided to structure 202. Cross-section 240 and number of centerlines 244 of channel 228 may be selected such that sealant 214 is applied to a desired location of structure 202.

Second end 235 may have at least one of guide surface 246, sealant surface 248, or forming surface 250. Guide surface 246 may be configured to contact first surface 252 of structure 202 as application tip 206 moves relative to structure 202. Sealant surface 248 may be configured to contact second surface 254 of structure 202 as application tip 206 moves relative to structure 202. Sealant surface 248 contacts second surface 254 of structure 202 as application tip 206 moves relative to structure 202 to form closed cross-section 255 for sealant 214 between structure 202 and application tip 206. In some examples, application tip 206 and structure 202 may function as a type of moving nip to form closed cross-section 255 for sealant 214. Forming surface 250 may be configured to form exterior shape 256 of sealant 214 as application tip 206 deposits sealant 214.

Guide surface 246 may guide application tip 206 as it deposits sealant 214. Sealant surface 248 may prevent or substantially discourage sealant 214 from extending past a desirable area of structure 202. Sealant surface 248 may be used instead of masking areas of structure 202 where it would be undesirable to have sealant 214. Using application tip 206 with sealant surface 248 may thus reduce manufacturing time by reducing or eliminating the need for masking or removal of excess sealant 214 on structure 202.

Forming surface 250 may have at least one of concave surface 258 or convex surface 259. When forming surface 250 is concave surface 258, concave surface 258 may be complementary to convex surface 260 of sealant 214. When forming surface 250 is convex surface 259, convex surface 259 may be complementary to concave surface 261 of sealant 214. In some illustrative examples, at least a portion of second end 235 may be rounded 262.

When application tip 206 applies sealant 214 to structure 202, application tip 206 may have tilt angle 264 and leading angle 266 relative to structure 202. At least one of forming surface 250, guide surface 246, or sealant surface 248 may be designed based on tilt angle 264 and leading angle 266. Channel 228 may be designed based on at least one of shape 232 of housing 230, tilt angle 264, or leading angle 266.

Tilt angle 264 may be an angle of application tip 206 relative to plane 268 running through structure 202. Leading angle 266 may be an angle of application tip 206 relative to normal axis 270 of structure 202. Leading angle 266 may be selected to produce desirable properties in sealant 214. For example, leading angle 266 may be selected to provide desirable application of sealant 214. Leading angle 266 may be selected to reduce chatter in movement of application tip 206 relative to structure 202. Leading angle 266 may reduce or eliminate ripples in sealant 214.

Structure 202 may be known structure type 271. For example, known structure type 271 may take the form of a portion of wing 102 of FIG. 1. As another example, known structure type 271 may take the form of a portion of body 106 of FIG. 1. Design dimensions 272 of known structure type 271 may be known prior to application of sealant 214 to structure 202. Structure 202 may have manufacturing variations 274. Manufacturing variations 274 may cause actual dimensions 275 of structure 202 to vary from design dimensions 272. Manufacturing variations 274 may affect desired movements of application tip 206 to apply sealant 214 to structure 202.

Prior to applying sealant 214, sealant application path 278 for structure 202 may be generated. Controller 210 may control movement of application tip 206 according to sealant application path 278.

Sealant application path 278 may be generated by modifying approximate path 280 of known structure type 271. Scanning system 208 may scan surface 282 of structure 202 with vision system 283 to form scanned data 284. Scanned data 284 may be a representation of actual dimensions 275 of structure 202. Approximate path 280 may be modified using scanned data 284 and design dimensions 272. In some illustrative examples, approximate path 280 may be modified based on differences 285 between design dimensions 272 and scanned data 284.

Controller 210 may use sealant application path 278 to control movement of application tip 206 to apply sealant 214 to desired location 286 on structure 202. Desired location 286 for sealant 214 on structure 202 may be at least a portion of joint 287 between first component 288 and second component 289 of structure 202.

Structure 202 may also have number of complex geometries 290. In some illustrative examples, number of complex geometries 290 may be a number of obstacles or other items relative to desired location 286 that may interfere with application tip 206. For example, number of complex geometries 290 may include a ridge, an additional component, a number of bolts, a number of rivets, or any other item which may potentially interfere with application tip 206 while applying sealant 214 to structure 202. In some illustrative examples, guide surface 246 may be desired based on tilt angle 264, leading angle 266, and number of complex geometries 290. In some illustrative examples, guide surface 246 may contact number of complex geometries 290 during application of sealant 214. In some illustrative examples, guide surface 246 may be substantially complementary to number of complex geometries 290.

In some illustrative examples, application tip 206 may be only one of plurality of application tips 291. Application tip 206 may be selected based on at least one of known structure type 271, approximate path 276, or sealant application path 278. In some illustrative examples, scanned data 284 including number of complex geometries 290 may change a desirable application tip of plurality of application tips 291. Scanned data 284 may be used to identify a desirable application tip.

In some illustrative examples, exterior shape 256 of sealant 214 to be applied to structure 202 may be determined based on scanned data 284. In some illustrative examples, exterior shape 256 of sealant 214 to be applied to structure 202 may be determined based on at least one of known structure type 271 or approximate path 280. Application tip 206 may be selected based on exterior shape 256 of sealant 214. In some illustrative examples, application tip 206 may be selected based on identifying number of complex geometries 290. In some illustrative examples, application tip 206 may be selected based on at least one of tilt angle 264 or leading angle 266.

In some illustrative examples, scanning system 208 may be connected to tool 204. In other illustrative examples, scanning system 208 may move independently of tool 204.

Tool 204 may be moved relative to structure 202 using movement system 212. Movement system 212 may include a robotic arm or any other desirable form of movement system. Movements of tool 204 may be controlled by controller 210.

Controller 210 may be implemented in software, hardware, firmware, or a combination thereof. When software is used, the operations performed by controller 210 may be implemented in program code configured to run on a processor unit. When firmware is used, the operations performed by controller 210 may be implemented in program code and data and stored in persistent memory to run on a processor unit. When hardware is employed, the hardware may include circuits that operate to perform the operations in controller 210.

Sealant 214 may be inspected using inspection system 292 to determine if sealant 214 is within selected tolerances. Inspecting sealant 214 using inspection system 292 may form inspection data 294. In some illustrative examples, sealant 214 may be inspected during application of sealant 214 by application tip 206. For example, inspection system 292 may also be connected to tool 204. In other illustrative examples, inspection system 292 may inspect sealant 214 after application tip 206 has completed applying sealant 214.

In some illustrative examples, inspection system 292 may inspect sealant 214 looking for an out of tolerance state in exterior shape 256. In some illustrative examples, inspection system 292 may inspect sealant 214 looking for out of tolerance applied sealant including at least one of ripples, bubbles, or other features of sealant 214. Inspection system 292 may continuously and automatically inspect to determine if sealant 214 is within tolerances. Inspection system 292 may inspect for ripples or bubbles by inspecting the interior of sealant 214 using x-rays.

The illustration of manufacturing environment 200 in FIG. 2 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, although second end 235 is depicted as having guide surface 246, in some illustrative examples, second end 235 may not have guide surface 246. As another example, second end 235 may not have at least a portion that is rounded 262. Further, in some illustrative examples, channel 228 may not have curved portion 238. In some examples, channel 228 may have number of centerlines 244 greater than one without curved portion 238.

Figure 3:
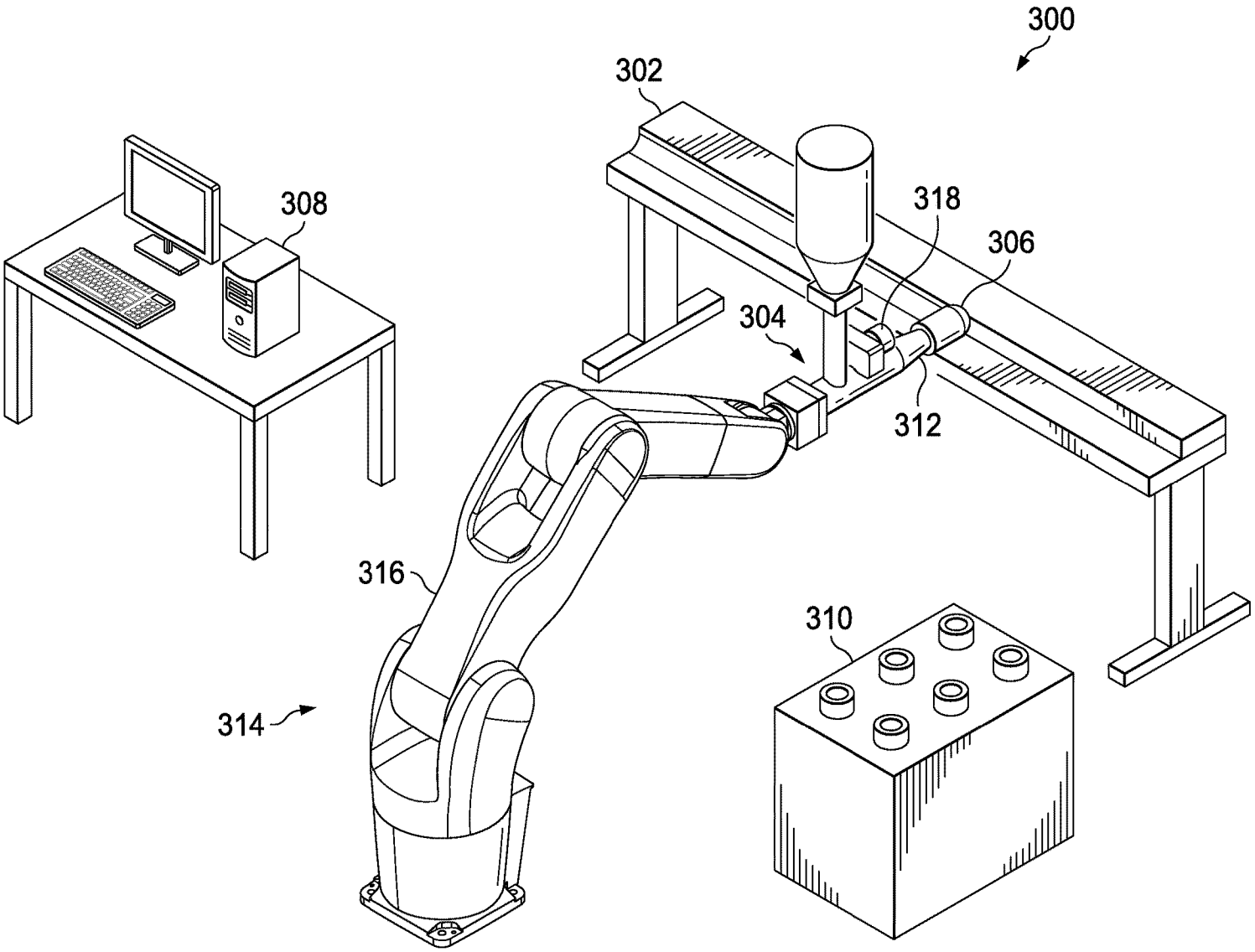
FIG. 3 is an illustration of an isometric view of a manufacturing environment in accordance with an illustrative embodiment.

Turning now to FIG. 3, an illustration of an isometric view of a manufacturing environment is depicted in accordance with an illustrative embodiment. Manufacturing environment 300 may be a physical implementation of manufacturing environment 200. Manufacturing environment 300 may be an example of a manufacturing environment for applying sealant to an aircraft part during manufacturing of aircraft 100 of FIG. 1.

Manufacturing environment 300 includes structure 302, tool 304, and application tip 306. Controller 308 may be used to control movement of tool 304 relative to at least one of application tip 306 or structure 302. For example, controller 308 may control movement of tool 304 relative to application tip storage 310 to place application tip 306 onto nozzle 312 of tool 304. After application tip 306 is connected to nozzle 312 of tool 304, controller 308 may control movements of application tip 306 and tool 304 relative to structure 302. For example, controller 308 may control movements of application tip 306 relative to structure 302 while application tip 306 deposits sealant on structure 302.

To control movement of tool 304, controller 308 may send commands to movement system 314. As depicted, movement system 314 may take the form of robotic arm 316.

Controller 308 may control the tilt angle and leading angle of application tip 306 relative to structure 302. Controller 308 may determine the tilt angle and leading angle of application tip 306 based on at least one of structure 302, the portion of structure 302 to receive sealant, the type of sealant, the shape of application tip 306, encountered chatter while moving application tip 306, or a desired shape of the sealant to be applied.

Controller 308 may also control the speed at which application tip 306 travels relative to structure 302. Controller 308 may also control the volumetric flow of sealant from nozzle 312 of tool 304. In some illustrative examples, controller 308 may control the speed at which application tip 306 travels relative to structure 302 based on the volumetric flow of sealant from nozzle 312 of tool 304. In some illustrative examples, controller 308 may control the volumetric flow of sealant from nozzle 312 of tool 304 based on the speed at which application tip 306 travels relative to structure 302.

Controller 308 may control aspects of application of a sealant based on results of at least one sensor. The at least one sensor may include at least one of a gyroscopic sensor, a flow sensor, a vision sensor, an x-ray detector, an inspection system, or any other desirable type of sensor. In some illustrative examples, controller 308 may control at least one of the volumetric flow of sealant from nozzle 312, the speed at which application tip 306 travels, a lead angle of application tip 306 relative to structure 302, a tilt angle of application tip 306 relative to structure 302, or the direction of movement of application tip 306 based on inspection of the applied sealant.

In some illustrative examples, each sealant design may have its own desirable application tip 306 speed, sealant volumetric flow, tilt angle, and leading angle. These variables may be determined based on at least one of the portion of structure 302 to receive sealant, the shape of application tip 306, the type of sealant, or the shape of the sealant to be created.

In some illustrative examples, at least one of application tip 306 speed, sealant volumetric flow, tilt angle, or leading angle may be a generic value. In these illustrative examples, a generic value may be used unless a specific value is provided for a specific sealant application process.

In some illustrative examples, controller 308 may adjust at least one of application tip 306 speed, sealant volumetric flow, tilt angle, and leading angle based on the actual performance during application of sealant. In some illustrative examples, controller 308 may adjust a desirable value for at least one of application tip 306 speed, sealant volumetric flow, tilt angle, or leading angle based on the qualities of the sealant after application of the sealant.

At least one of the quality or exterior shape of the sealant may be inspected during application or after application using inspection system 318. As depicted, inspection system 318 may be connected to tool 304 and moved using movement system 314. In other illustrative examples, inspection system 318 may be moved independently of tool 304.

Moving tool 304 using robotic arm 316 may move application tip 306 relative to structure 302. Moving robotic arm 316 may also adjust at least one of a leading angle or a tilt angle of application tip 306 relative to structure 302.

Figure 4:
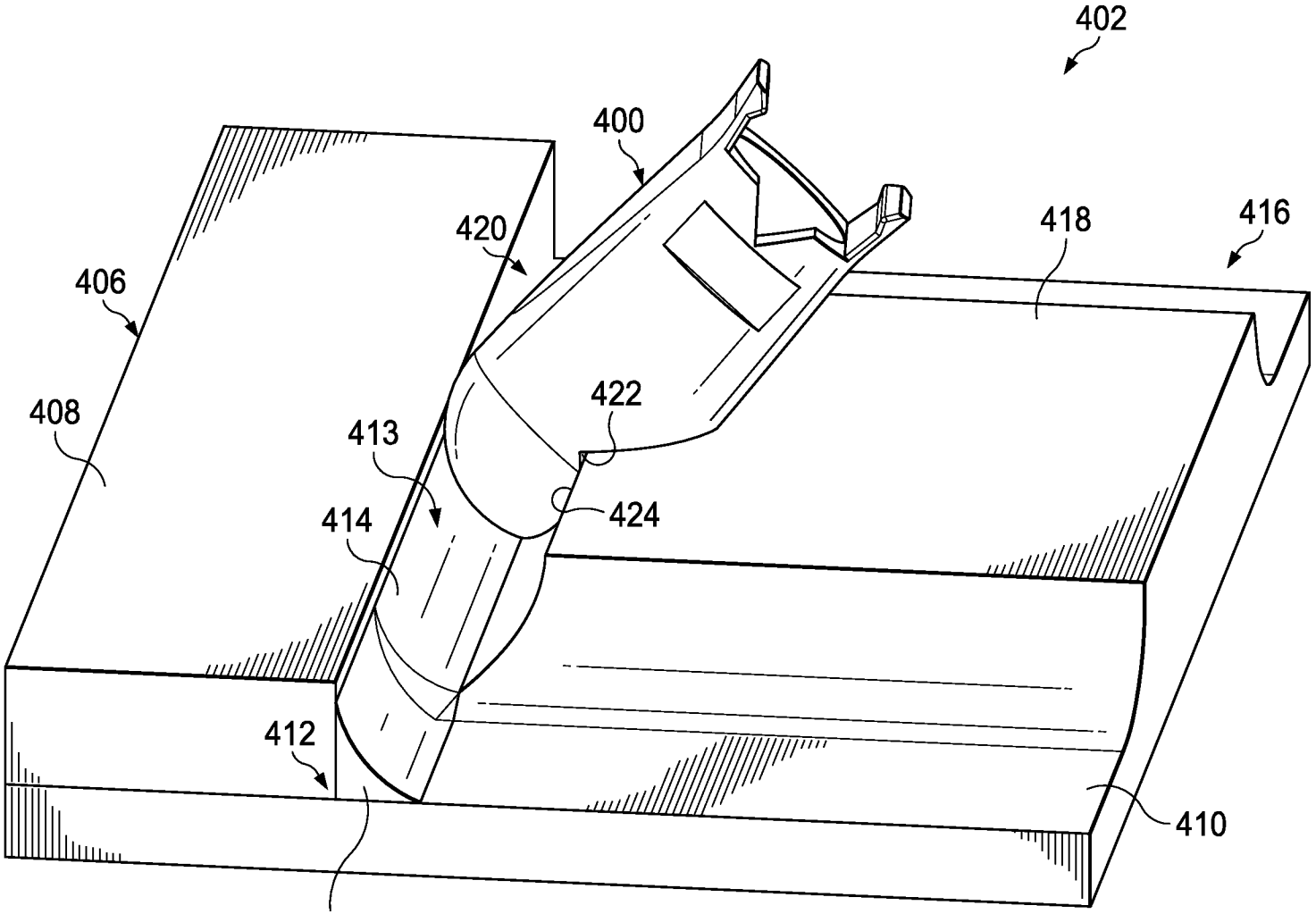
FIG. 4 is an illustration of an isometric view of one implementation of an application tip applying sealant to a structure in accordance with an illustrative embodiment.

Turning now to FIG. 4, an illustration of an isometric view of one implementation of an application tip applying sealant to a structure is depicted in accordance with an illustrative embodiment. Application tip 400 in view 402 may be a physical implementation of application tip 206 of FIG. 2. Although not depicted in view 402 for simplification, application tip 400 would be connected to a tool having a sealant source.

In view 402, application tip 400 may deposit sealant 404 to structure 406. In this illustrative example, structure 406 includes first component 408 and second component 410. Application tip 400 may deposit sealant 404 at joint 412 between first component 408 and second component 410.

As depicted, exterior shape 413 of sealant 404 includes concave surface 414. In this illustrative example, structure 406 includes number of complex geometries 416. As depicted, second component 410 may include raised portion 418. Number of complex geometries 416 may include raised portion 418.

As depicted, application tip 400 may have shape 420. Shape 420 may include guide surface 422. Guide surface 422 may contact raised portion 418 of structure 406 in FIG. 4 as application tip 400 applies sealant to structure 406. More specifically, guide surface 422 may contact edge 424 of raised portion 418.

Figure 5:
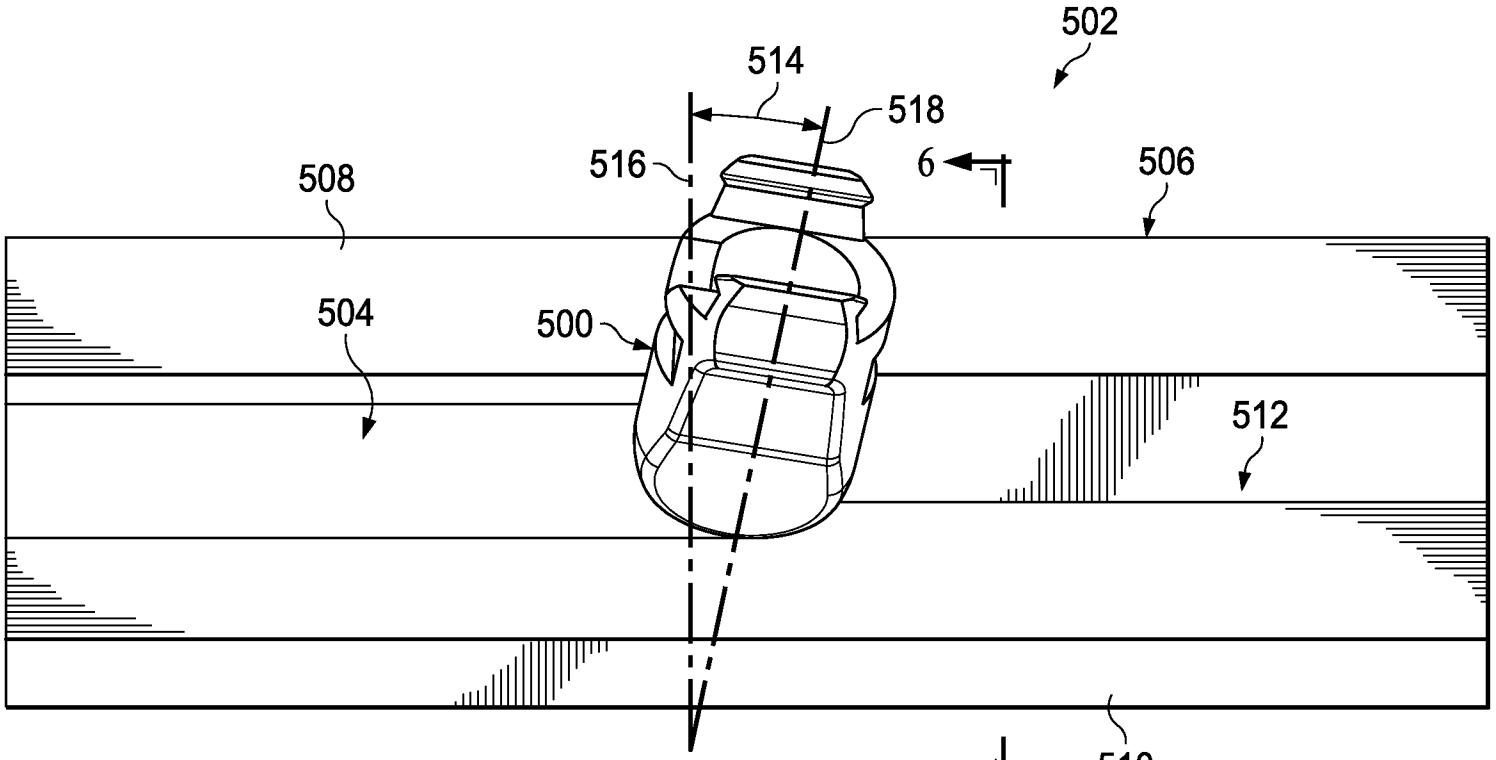
FIG. 5 is an illustration of a back view of one implementation of an application tip applying sealant to a structure in accordance with an illustrative embodiment.

Turning now to FIG. 5, an illustration of a back view of one implementation of an application tip applying sealant to a structure is depicted in accordance with an illustrative embodiment. Application tip 500 in view 502 may be a physical implementation of application tip 206 of FIG. 2. Although not depicted in view 502 for simplification, application tip 500 would be connected to a tool having a sealant source.

In view 502, application tip 500 may deposit sealant 504 to structure 506. In this illustrative example, structure 506 includes first component 508 and second component 510. Application tip 500 may deposit sealant 504 at joint 512 between first component 508 and second component 510.

As depicted, application tip 500 has leading angle 514. As depicted, leading angle 514 may be an angle between normal axis 516 of second component 510 of structure 506 and centerline 518 of application tip 500. In some illustrative examples, leading angle 514 could be an angle between normal axis 516 of first component 508 of structure 506 and centerline 518 of application tip 500. Centerline 518 may be a centerline of a conical portion (not depicted) of a channel (not depicted) of application tip 500. Leading angle 514 may reduce chatter in movement of application tip 500 relative to structure 506. Leading angle 514 may reduce or eliminate ripples in sealant 504 due to chatter.

Figure 6:
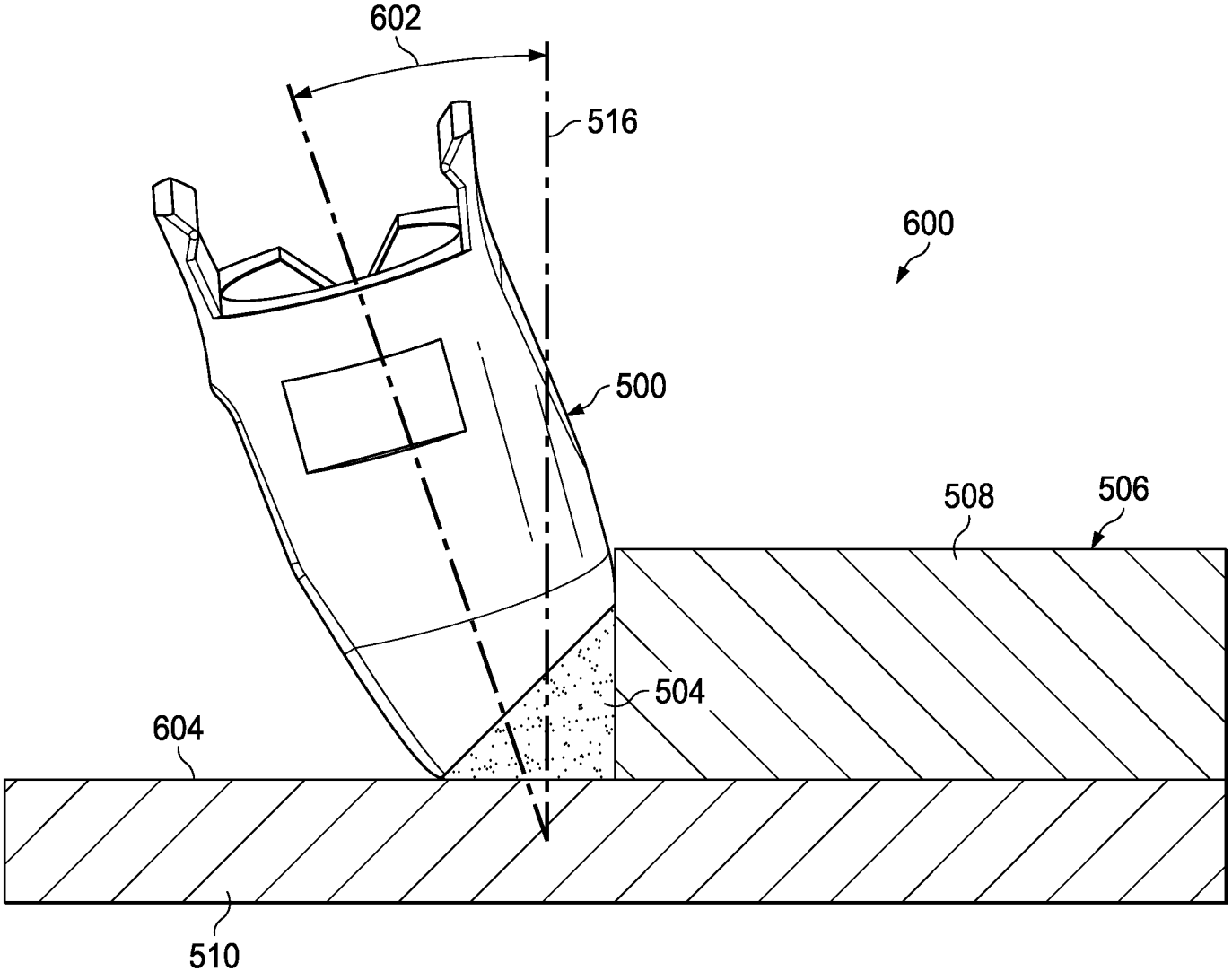
FIG. 6 is an illustration of a front view of one implementation of an application tip applying sealant to a structure in accordance with an illustrative embodiment.

Turning now to FIG. 6, an illustration of a front view of one implementation of an application tip applying sealant to a structure is depicted in accordance with an illustrative embodiment. View 600 may be a view of application tip 500 from direction 6 of FIG. 5.

Application tip 500 has tilt angle 602. Tilt angle 602 is an angle of application tip 500 relative to structure 506. Tilt angle 602 may be referenced relative to normal axis 516 of structure 506.

Although tilt angle 602 is described as relative to normal axis 516, tilt angle 602 may instead be described relative to any desirable location such as surface 604, a plane extending through second component 510, an orthogonal intersection between first component 508 or second component 510, or any other desirable location. Tilt angle 602 may be determined based on at least one of surface 604 of second component 510, geometry of structure 506, position and kinematics of a movement system moving application tip 500, or any other characteristic of the manufacturing environment.

In some illustrative examples, surface 604 of second component 510 may be planar. In some illustrative examples, surface 604 of second component 510 may be substantially non-planar. For example, surface 604 of second component 510 may have contours. In some illustrative examples in which surface 604 is non-planar, tilt angle 602 may remain substantially the same relative to surface 604 of second component 510 but may change relative to an absolute XYZ coordinate system.

In some illustrative examples, it may be desirable to have tilt angle 602 be substantially the same as application tip 500 moves across surface 604 of second component 510. In some illustrative examples, it may be desirable to change tilt angle 602 as application tip 500 moves across surface 604 of second component 510.

In some illustrative examples, tilt angle 602 may be changed based on inspection of sealant applied by application tip 500. For example, changing tilt angle 602 may change at least one of the size or shape of the formed nip. Changing the size or shape of the formed nip may therefore change the cross-sectional shape of the applied sealant. In some illustrative examples, tilt angle 602 may be changed to adjust a shape of sealant applied by application tip 500.

As another example, tilt angle 602 may be changed if the applied sealant is out of tolerance. For example, tilt angle 602 may be changed if at least one of an exterior shape, ripples, or bubbles in the sealant applied by application tip 500 is out of tolerance.

A controller or another computer system may be used to perform a determination if an out of tolerance condition exists. To determine if an out of tolerance condition exists, inspection data may be compared to designed dimensions for sealant. If there is a difference between the inspection data and designed dimensions for the sealant, the sealant may be out of tolerance. In some illustrative examples, for ripples, bubbles, or some other conditions, an out of tolerance condition may exist if a count of the condition is higher than a set value. In some illustrative examples, for ripples, bubbles, or other conditions, an out of tolerance condition may exist if a size of the condition is higher than a set value.

Figure 7:
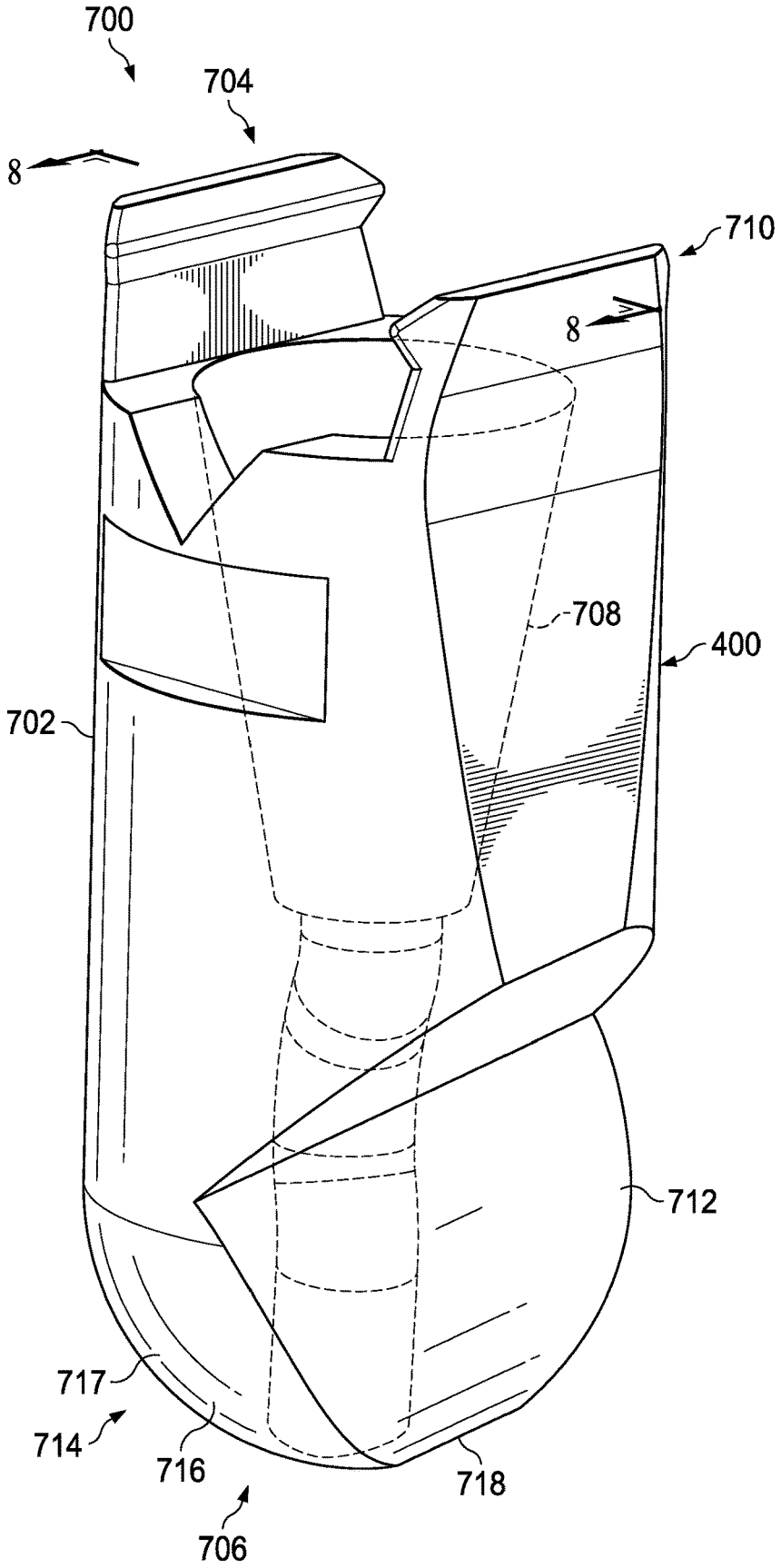
FIG. 7 is an illustration of a transparent view of an application tip in accordance with an illustrative embodiment.

Turning now to FIG. 7, an illustration of a transparent view of an application tip is depicted in accordance with an illustrative embodiment. View 700 may be an isometric transparent view of application tip 400 of FIG. 4.

Application tip 400 may include housing 702 having first end 704 and second end 706. Channel 708 may extend from first end 704 to second end 706. First end 704 may include number of connections 710. Number of connections 710 may connect application tip 400 to a tool such as tool 204 of FIG. 2.

In this illustrative example, second end 706 of application tip 400 may include guide surface 422. Guide surface 422 may contact raised portion 418 of structure 406 in FIG. 4 as application tip 400 applies sealant to structure 406. Guide surface 422 may be designed based on a desired tilt angle and a desired leading angle for application tip 400.

Second end 706 may also include rounded portion 714. Rounded portion 714 may include forming surface 716, sealant surface 717, and sealant surface 718. Forming surface 716 may contact sealant 404 to form exterior shape 413 of FIG. 4. Sealant surface 717 and sealant surface 718 may contact surfaces of first component 408 and second component 410 of FIG. 4, respectively, to restrict sealant 404 to a desired space. Sealant surface 717 and sealant surface 718 may contact surfaces of first component 408 and second component 410 of FIG. 4, respectively, to create a shaping nip between application tip 400 and structure 406. Sealant surface 717 and sealant surface 718 may eliminate masking on structure 406.

Figure 8:
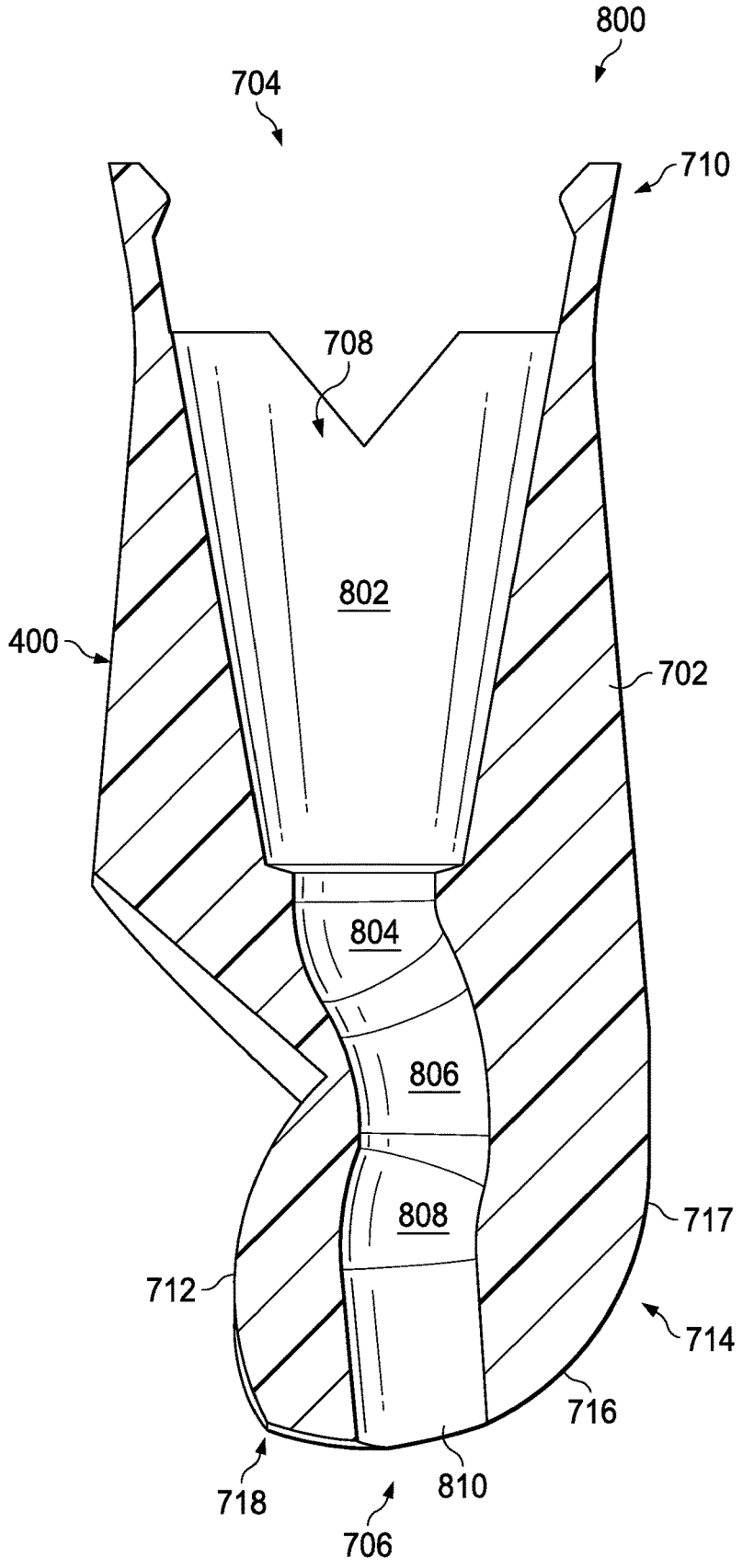
FIG. 8 is an illustration of a cross-sectional view of an application tip in accordance with an illustrative embodiment.

Turning now to FIG. 8, an illustration of a cross-sectional view of an application tip is depicted in accordance with an illustrative embodiment. View 800 may be a cross-sectional view of application tip 400 of FIGS. 4 and 7. View 800 may be a cross-sectional view of application tip 400 from direction 8 of FIG. 7. As depicted, channel 708 of application tip 400 may have conical portion 802. Conical portion 802 may interface with a nozzle of a tool such as nozzle 218 of tool 204 of FIG. 2. Channel 708 may also include curve 804, curve 806, and curve 808. Each of curve 804, curve 806, and curve 808 may be different. Curve 804, curve 806, and curve 808 may connect conical portion 802 to exit 810. Curve 804, curve 806, and curve 808 may be designed based on at least one of guide surface 422, desired location of exit 810, and desired placement of conical portion 802.

Shape of channel 708, including conical portion 802, curve 804, curve 806, and curve 808, may be configured to promote transport of a liquid with a desired viscosity. For example, shape of channel 708, including conical portion 802, curve 804, curve 806, and curve 808, may be configured to promote transport of a desired sealant. In some examples, shape of channel 708, including conical portion 802, curve 804, curve 806, and curve 808, may be configured based on a desired flow rate of the sealant.

Figure 9:
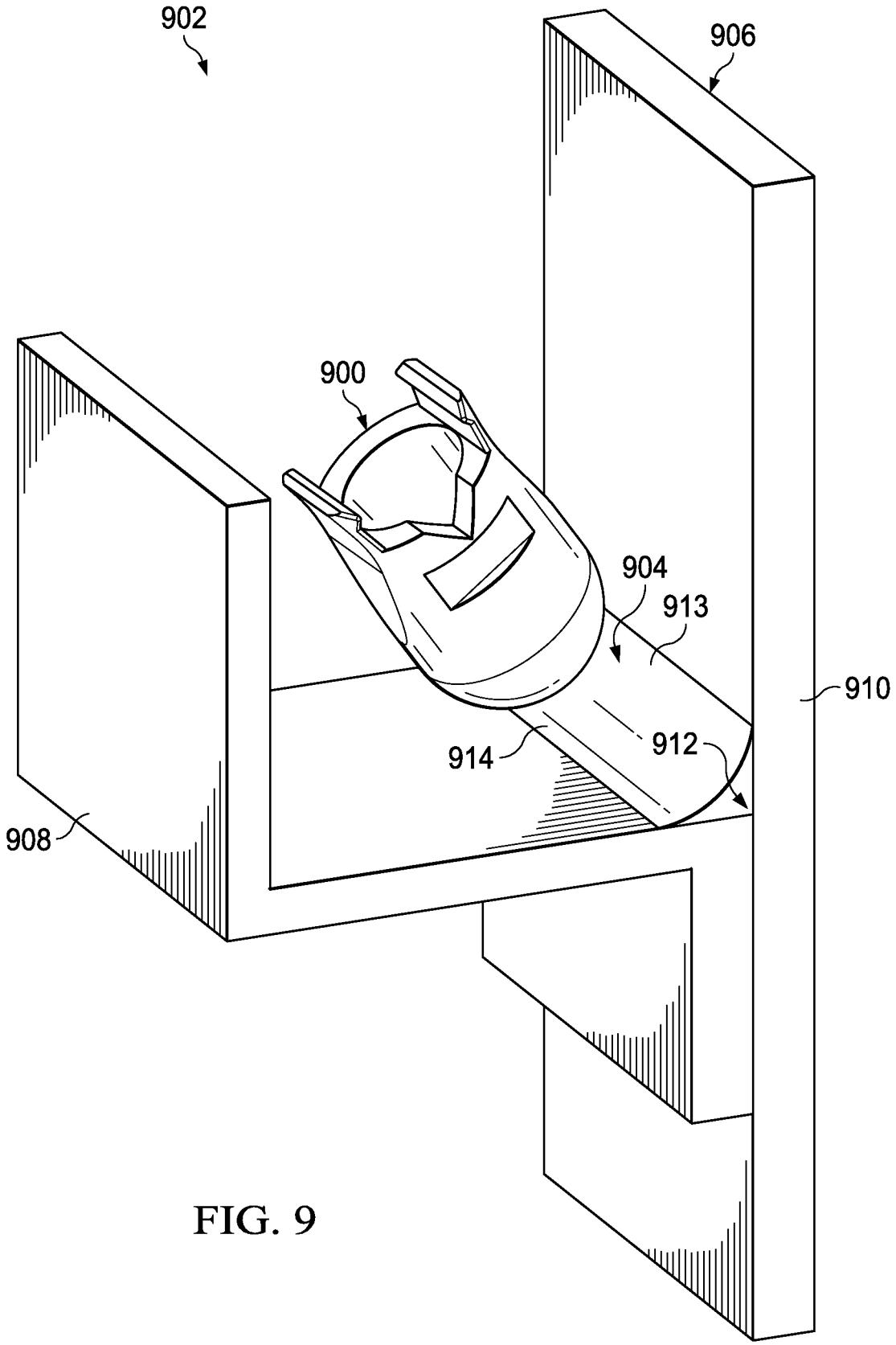
FIG. 9 is an illustration of an isometric view of one implementation of an application tip applying sealant to a structure in accordance with an illustrative embodiment.

Turning now to FIG. 9, an illustration of an isometric view of one implementation of an application tip applying sealant to a structure is depicted in accordance with an illustrative embodiment. Application tip 900 in view 902 may be a physical implementation of application tip 206 of FIG. 2. Although not depicted in view 902 for simplification, application tip 900 would be connected to a tool having a sealant source.

In view 902, application tip 900 may deposit sealant 904 to structure 906. In this illustrative example, structure 906 includes first component 908 and second component 910. Application tip 900 may deposit sealant 904 at joint 912 between first component 908 and second component 910.

As depicted, exterior shape 913 of sealant 904 includes concave surface 914. In this illustrative example, structure 906 does not include a number of complex geometries. As a result, application tip 900 may not include a guide surface.

Figure 10:
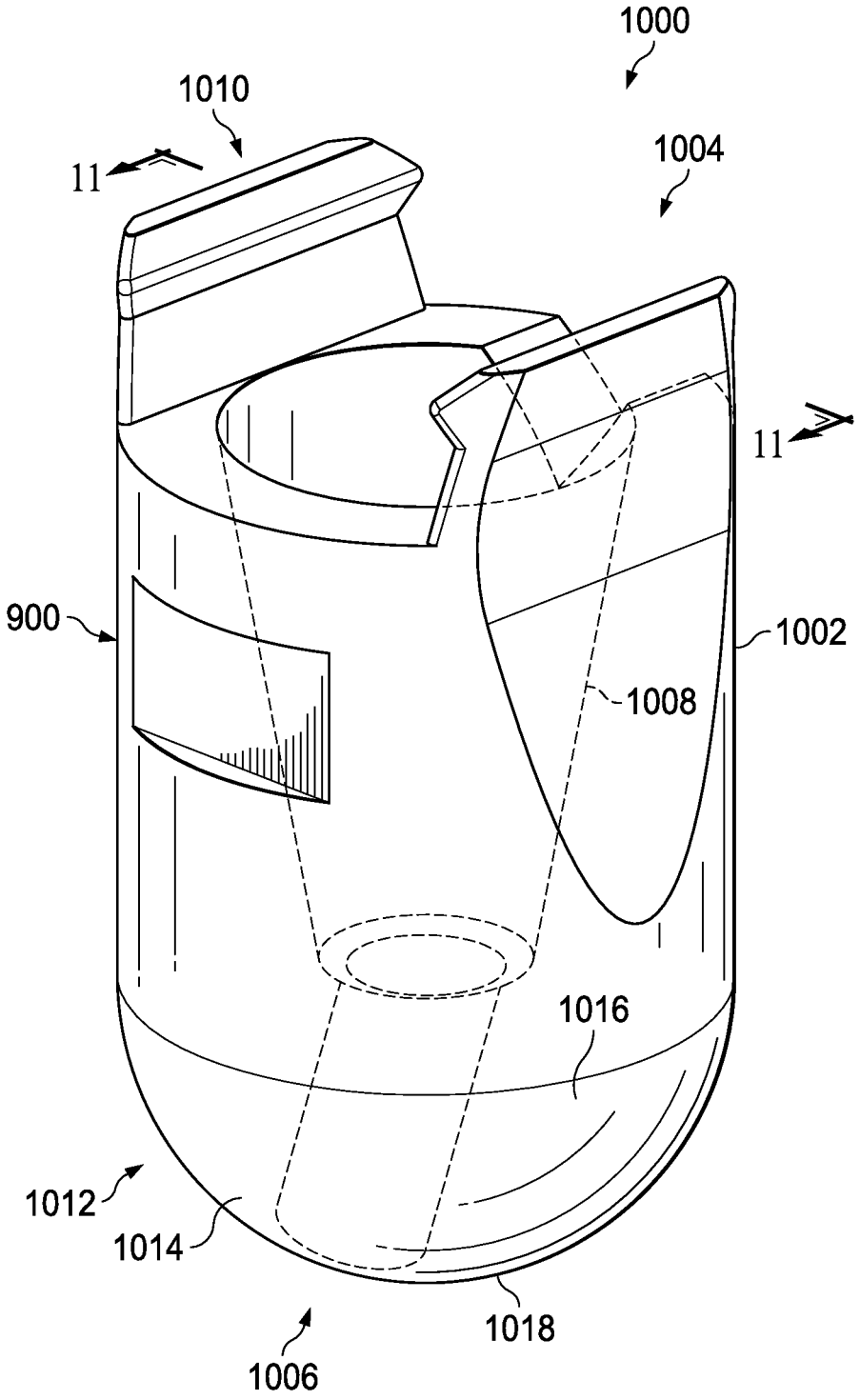
FIG. 10 is an illustration of a transparent view of an application tip in accordance with an illustrative embodiment.

Turning now to FIG. 10, an illustration of a transparent view of an application tip is depicted in accordance with an illustrative embodiment. View 1000 may be an isometric transparent view of application tip 900 of FIG. 9.

Application tip 900 may include housing 1002 having first end 1004 and second end 1006. Channel 1008 may extend from first end 1004 to second end 1006. First end 1004 may include number of connections 1010. Number of connections 1010 may connect application tip 900 to a tool such as tool 204 of FIG. 2.

In this illustrative example, second end 1006 of application tip 900 may include rounded portion 1012. Rounded portion 1012 may include forming surface 1014, sealant surface 1016, and sealant surface 1018. Forming surface 1014 may contact sealant 904 to form exterior shape 913 of FIG. 9. Sealant surface 1016 and sealant surface 1018 may contact surfaces of first component 908 and second component 910 of FIG. 9, respectively, to restrict sealant 904 to a desired space. Sealant surface 1016 and sealant surface 1018 may contact surfaces of first component 908 and second component 910 of FIG. 9, respectively, to create a shaping nip between application tip 900 and structure 906. Sealant surface 1016 and sealant surface 1018 may eliminate masking on structure 906.

Figure 11:
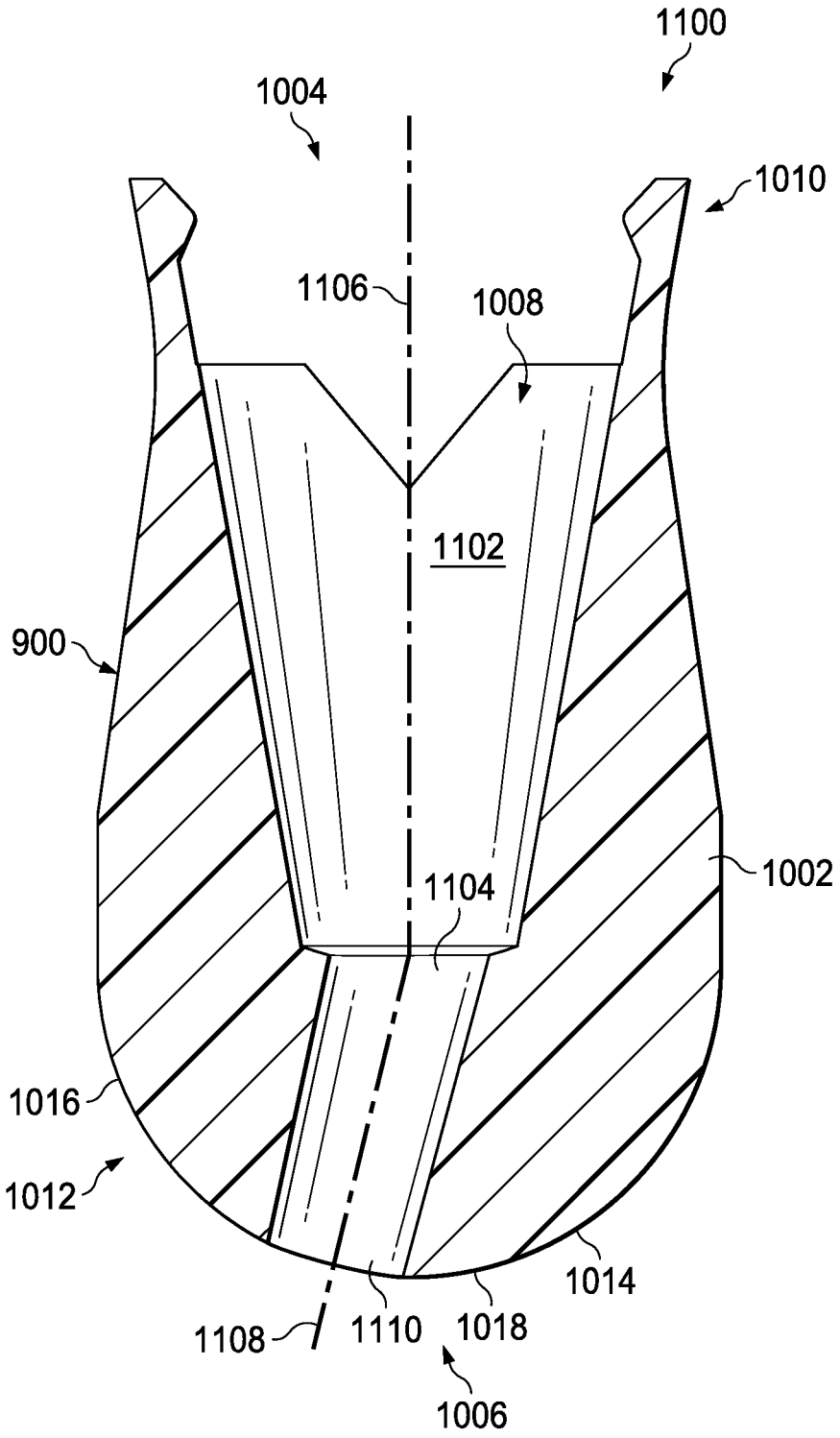
FIG. 11 is an illustration of a cross-sectional view of an application tip in accordance with an illustrative embodiment.

Turning now to FIG. 11, an illustration of a cross-sectional view of an application tip is depicted in accordance with an illustrative embodiment. View 1100 may be a cross-sectional view of application tip 900 of FIGS. 9 and 10. View 1100 may be a cross-sectional view of application tip 900 from direction 11 of FIG. 10. As depicted, channel 1008 of application tip 900 may have conical portion 1102. Conical portion 1102 may interface with a nozzle of a tool such as nozzle 218 of tool 204 of FIG. 2. Channel 1008 may also include varying portion 1104. As depicted, varying portion 1104 may have a circular cross-sectional shape throughout. However, in other illustrative examples, varying portion 1104 may vary in cross-sectional shape. For example, varying portion 1104 may be substantially circular on one side and substantially oval on an opposite side.

Conical portion 1102 may have centerline 1106. Varying portion 1104 may have centerline 1108. Centerline 1106 may be different from centerline 1108. Varying portion 1104 may connect conical portion 1102 to exit 1110. Varying portion 1104 may be designed based on at least one of desired location of exit 1110 or desired placement of conical portion 1102.

Shape of channel 1008, including conical portion 1102 and varying portion 1104, may be configured to promote transport of a liquid with a desired viscosity. For example, shape of channel 1008, including conical portion 1102 and varying portion 1104, may be configured to promote transport of a desired sealant. In some examples, shape of channel 1008, including conical portion 1102 and varying portion 1104, may be configured based on a desired flow rate of the sealant. For example, reduction of cross-sectional shape from conical portion 1102 to exit 1110 may increase the pressure of sealant in exit 1110 relative to the remainder of channel 1008 including conical portion 1102.

Figure 12:
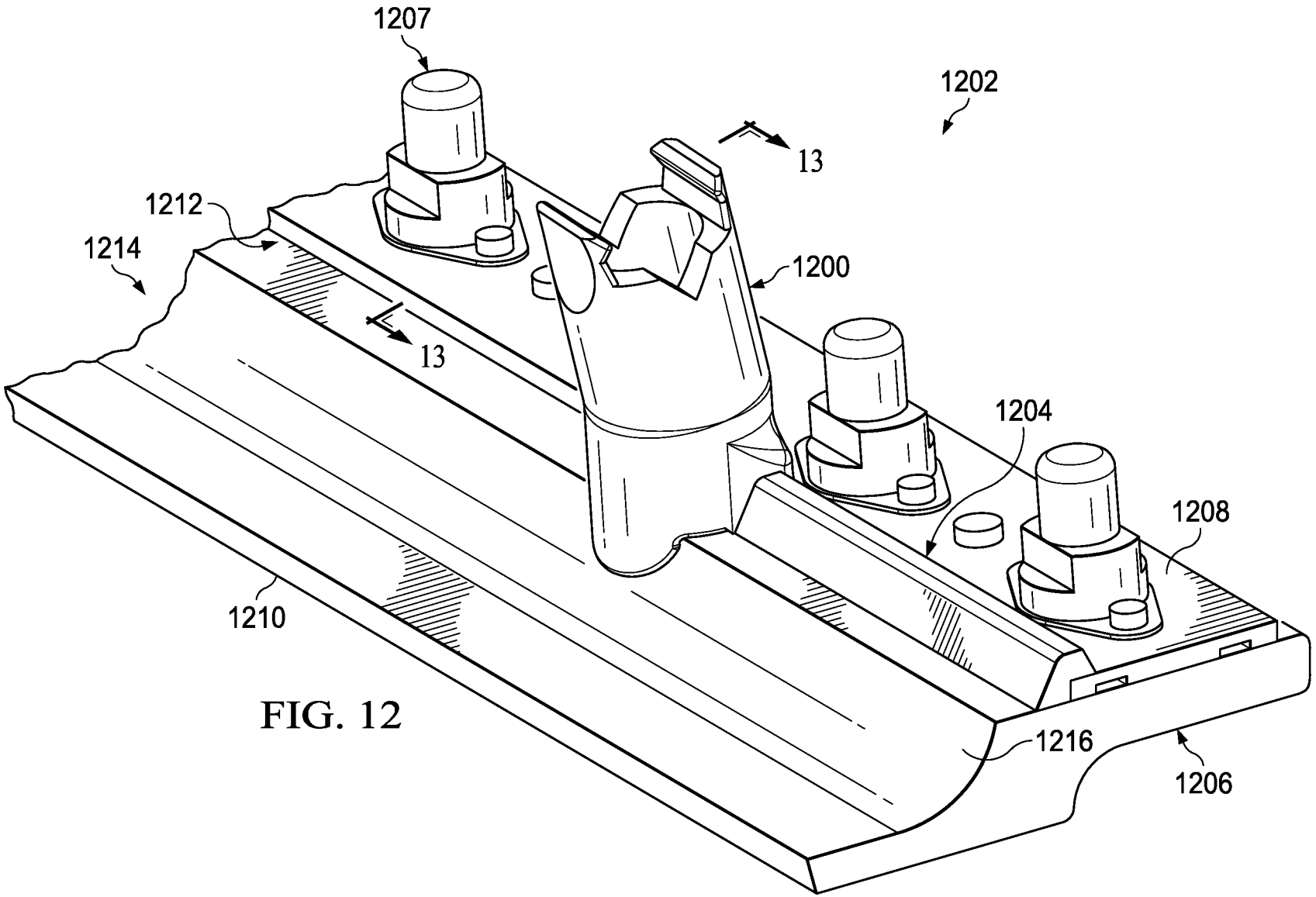
FIG. 12 is an illustration of an isometric view of one implementation of an application tip applying sealant to a structure in accordance with an illustrative embodiment.

Turning now to FIG. 12, an illustration of an isometric view of one implementation of an application tip applying sealant to a structure is depicted in accordance with an illustrative embodiment. Application tip 1200 in view 1202 may be a physical implementation of application tip 206 of FIG. 2. Although not depicted in view 1202 for simplification, application tip 1200 would be connected to a tool having a sealant source.

In view 1202, application tip 1200 may apply sealant 1204 to structure 1206. Structure 1206 may be referred to as a nut plate ring. Structure 1206 includes plurality of nut plates 1207. In this illustrative example, structure 1206 also includes first component 1208 and second component 1210. Application tip 1200 may deposit sealant 1204 at joint 1212 between first component 1208 and second component 1210. Sealant 1204 may also be referred to as an outside fillet sealant in this illustrative example.

In this illustrative example, second component 1210 of structure 1206 includes number of complex geometries 1214. As depicted, number of complex geometries 1214 may include dip 1216. Application tip 1200 may include a guide surface that may contact a portion of number of complex geometries 1214.

Figure 13:
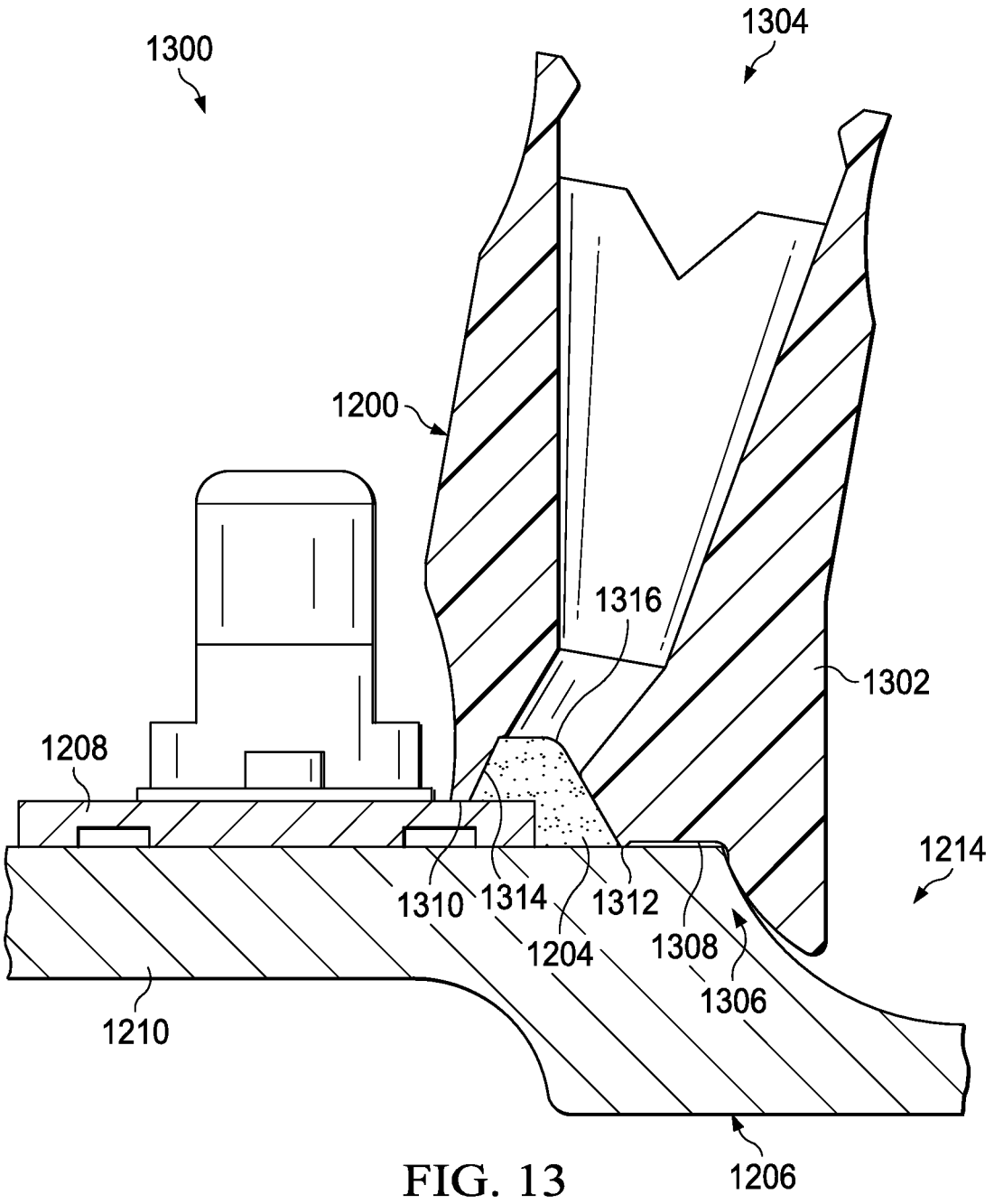
FIG. 13 is an illustration of a cross-sectional view of one implementation of an application tip applying sealant to a structure in accordance with an illustrative embodiment.

Turning now to FIG. 13, an illustration of a cross-sectional view of one implementation of an application tip applying sealant to a structure is depicted in accordance with an illustrative embodiment. View 1300 may be a cross-sectional view of application tip 1200 from direction 13 of FIG. 12.

Application tip 1200 may include housing 1302 having first end 1304 and second end 1306. Second end 1306 may have guide surface 1308, sealant surface 1310, sealant surface 1312, and forming surface 1314. Guide surface 1308 may contact portions of second component 1210 as application tip 1200 travels along structure 1206. Forming surface 1314 may form exterior shape 1316 of sealant 1204. Sealant surface 1310 may contact first component 1208 as application tip 1200 travels along structure 1206. Sealant surface 1312 may contact second component 1210 as application tip 1200 travels along structure 1206. Each of sealant surface 1310 and sealant surface 1312 may form a seal with structure 1206. Sealant surface 1312 and sealant surface 1310 may confine sealant 1204 underneath application tip 1200. Sealant surface 1312 and sealant surface 1310 may eliminate a masking step in manufacturing structure 1206. Sealant surface 1312 and sealant surface 1310 may contact surfaces of structure 1206 to create a shaping nip between application tip 1200 and structure 1206.

Figure 14:
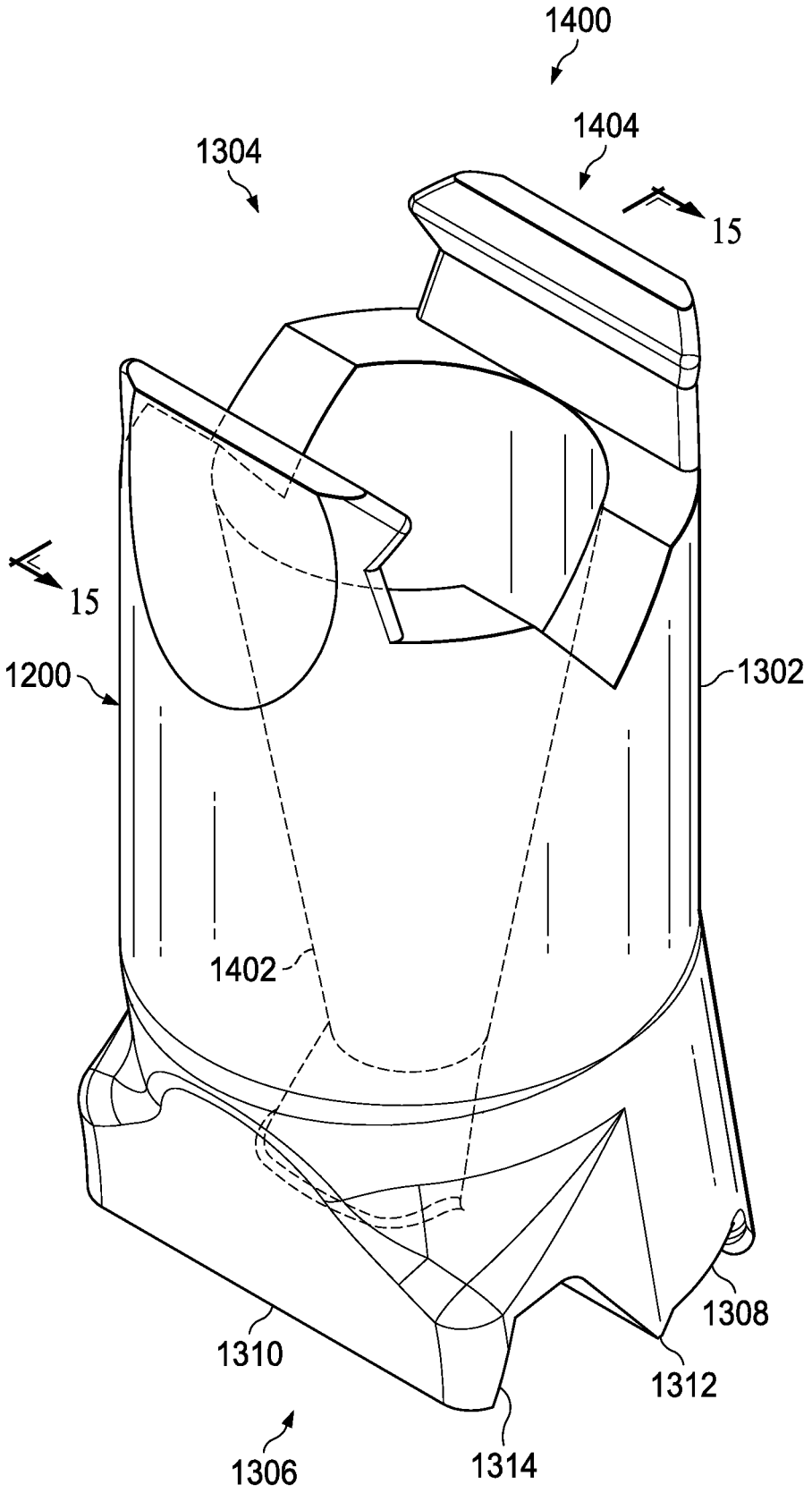
FIG. 14 is an illustration of a transparent view of an application tip in accordance with an illustrative embodiment.

Turning now to FIG. 14, an illustration of a transparent view of an application tip is depicted in accordance with an illustrative embodiment. View 1400 may be an isometric transparent view of application tip 1200 of FIGS. 12 and 13.

Application tip 1200 may include channel 1402. Channel 1402 may extend from first end 1304 to second end 1306. First end 1304 may include number of connections 1404. Number of connections 1404 may connect application tip 1200 to a tool such as tool 204 of FIG. 2.

Figure 15:
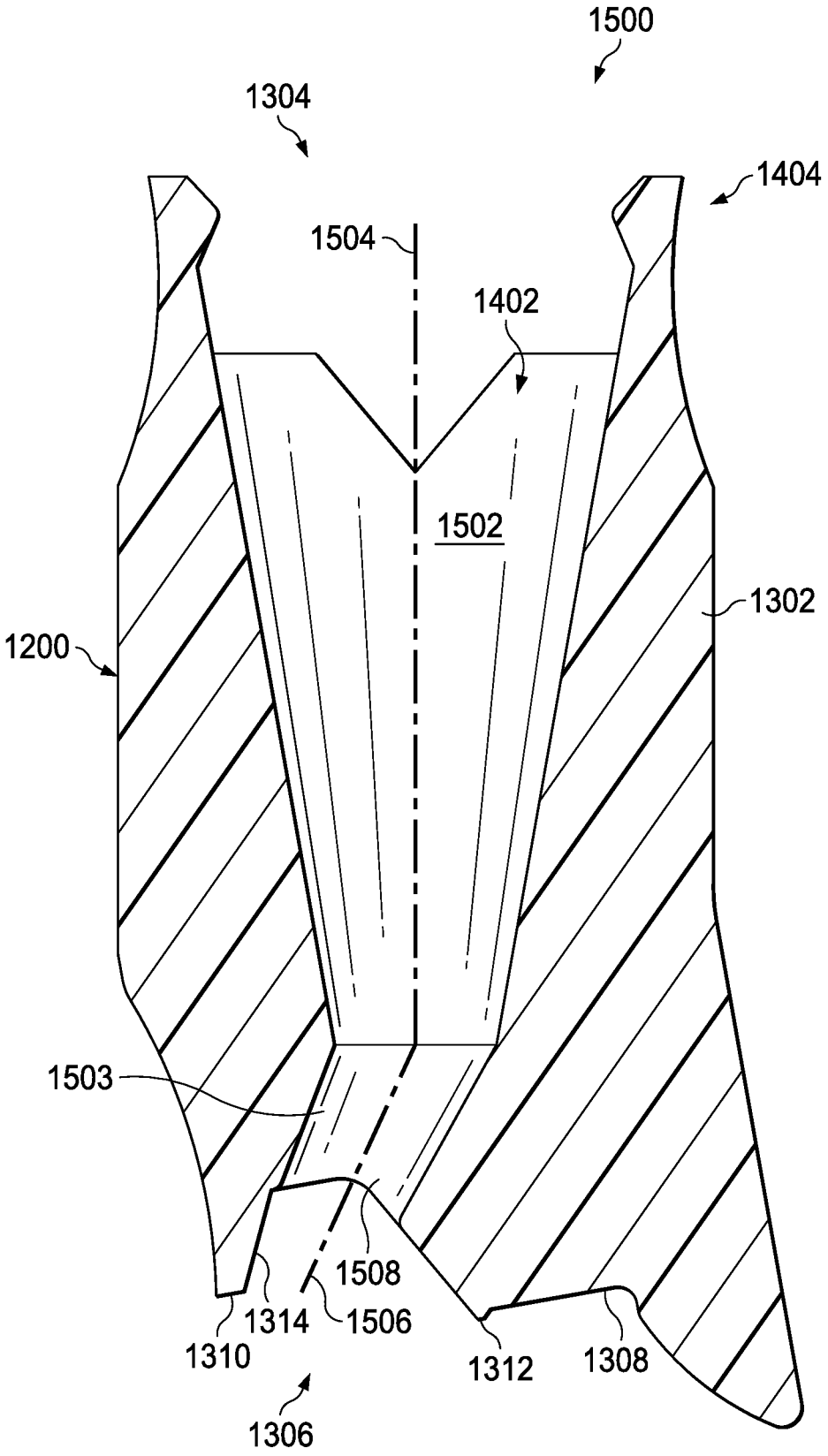
FIG. 15 is an illustration of a cross-sectional view of an application tip in accordance with an illustrative embodiment.

Turning now to FIG. 15, an illustration of a cross-sectional view of an application tip is depicted in accordance with an illustrative embodiment. View 1500 may be a cross-sectional view of application tip 1200 of FIGS. 12-14. View 1500 may be a cross-sectional view of application tip 1200 from direction 15 of FIG. 14. As depicted, channel 1402 of application tip 1200 may have conical portion 1502. Conical portion 1502 may interface with a nozzle of a tool such as nozzle 218 of tool 204 of FIG. 2. Channel 1402 may also include varying portion 1503. In this illustrative example, varying portion 1503 may vary in cross-sectional shape. For example, varying portion 1503 may be substantially circular on one side and substantially oval on an opposite side. However, in other illustrative examples, varying portion 1104 may have a same cross-sectional shape throughout. For example, varying portion 1104 may be circular throughout.

Conical portion 1502 may have centerline 1504. Varying portion 1503 may have centerline 1506. Centerline 1504 may be different from centerline 1506. Varying portion 1503 may connect conical portion 1502 to exit 1508. Varying portion 1503 may be designed based on at least one of desired location of exit 1508 or desired placement of conical portion 1502.

Shape of channel 1402, including conical portion 1502 and varying portion 1503, may be configured to promote transport of a liquid with a desired viscosity. For example, shape of channel 1402, including conical portion 1502 and varying portion 1503, may be configured to promote transport of a desired sealant. In some examples, shape of channel 1402, including conical portion 1502 and varying portion 1503, may be configured based on a desired flow rate of the sealant. For example, reduction of cross-sectional shape from conical portion 1502 to exit 1508 may increase the pressure of sealant in exit 1508 relative to the remainder of channel 1402 including conical portion 1502.

Figure 16:
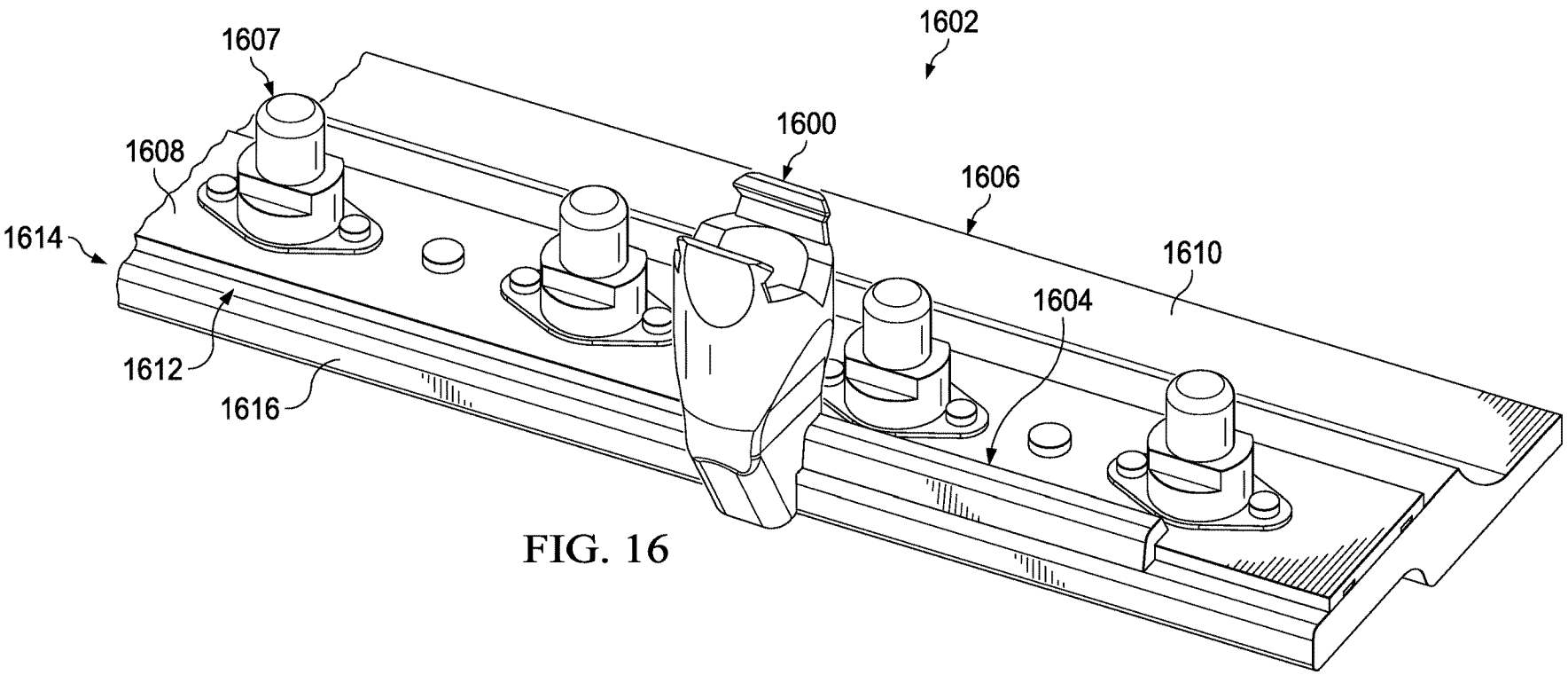
FIG. 16 is an illustration of an isometric view of one implementation of an application tip applying sealant to a structure in accordance with an illustrative embodiment.

Turning now to FIG. 16, an illustration of an isometric view of one implementation of an application tip applying sealant to a structure is depicted in accordance with an illustrative embodiment. Application tip 1600 in view 1602 may be a physical implementation of application tip 206 of FIG. 2. Although not depicted in view 1602 for simplification, application tip 1600 would be connected to a tool having a sealant source.

In view 1602, application tip 1600 may apply sealant 1604 to structure 1606. Structure 1606 may be referred to as a nut plate. Structure 1606 includes plurality of nuts 1607. In this illustrative example, structure 1606 also includes first component 1608 and second component 1610. Application tip 1600 may deposit sealant 1604 at joint 1612 between first component 1608 and second component 1610. Sealant 1604 may also be referred to as an inside fillet sealant in this illustrative example.

In this illustrative example, second component 1610 of structure 1606 includes number of complex geometries 1614. As depicted, number of complex geometries 1614 may include lip 1616. Application tip 1600 may include a guide surface that may contact a portion of number of complex geometries 1614.

Figure 17:
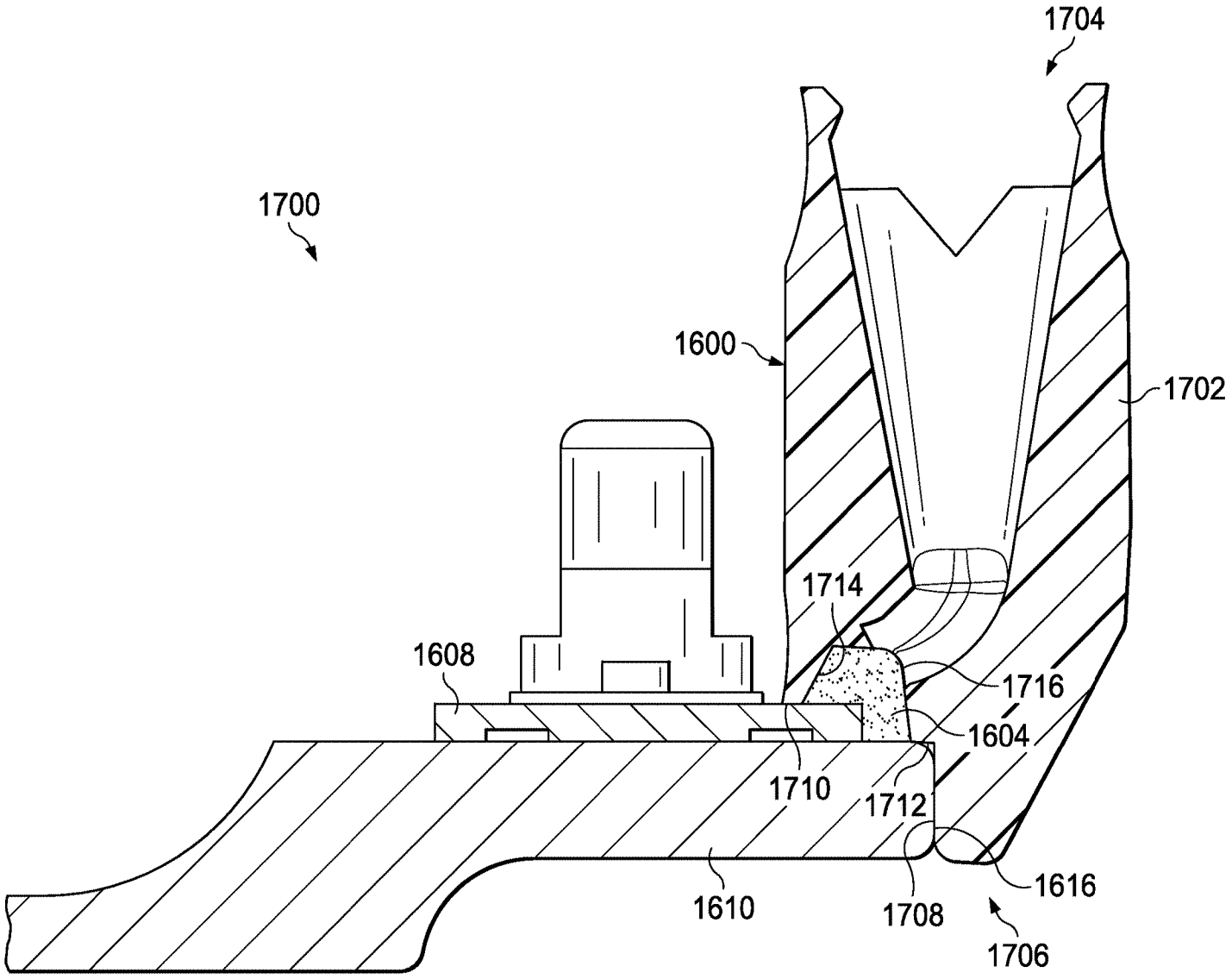
FIG. 17 is an illustration of a cross-sectional view of one implementation of an application tip applying sealant to a structure in accordance with an illustrative embodiment.

Turning now to FIG. 17, an illustration of a cross-sectional view of one implementation of an application tip applying sealant to a structure is depicted in accordance with an illustrative embodiment. View 1700 may be a cross-sectional view of application tip 1600 from direction 17 of FIG. 16.

Application tip 1600 may include housing 1702 having first end 1704 and second end 1706. Second end 1706 may have guide surface 1708, sealant surface 1710, sealant surface 1712, and forming surface 1714. Guide surface 1708 may contact portions of second component 1610 as application tip 1600 travels along structure 1606. Forming surface 1714 may form exterior shape 1716 of sealant 1604. Sealant surface 1710 may contact first component 1608 as application tip 1600 travels along structure 1606. Sealant surface 1712 may contact second component 1610 as application tip 1600 travels along structure 1606. Each of sealant surface 1710 and sealant surface 1712 may form a seal with structure 1606. Sealant surface 1712 and sealant surface 1710 may confine sealant 1604 underneath application tip 1600. Sealant surface 1712 and sealant surface 1710 may eliminate a masking step in manufacturing structure 1606. Sealant surface 1712 and sealant surface 1710 may contact surfaces of structure 1606 to create a shaping nip between application tip 1600 and structure 1606.

Figure 18:
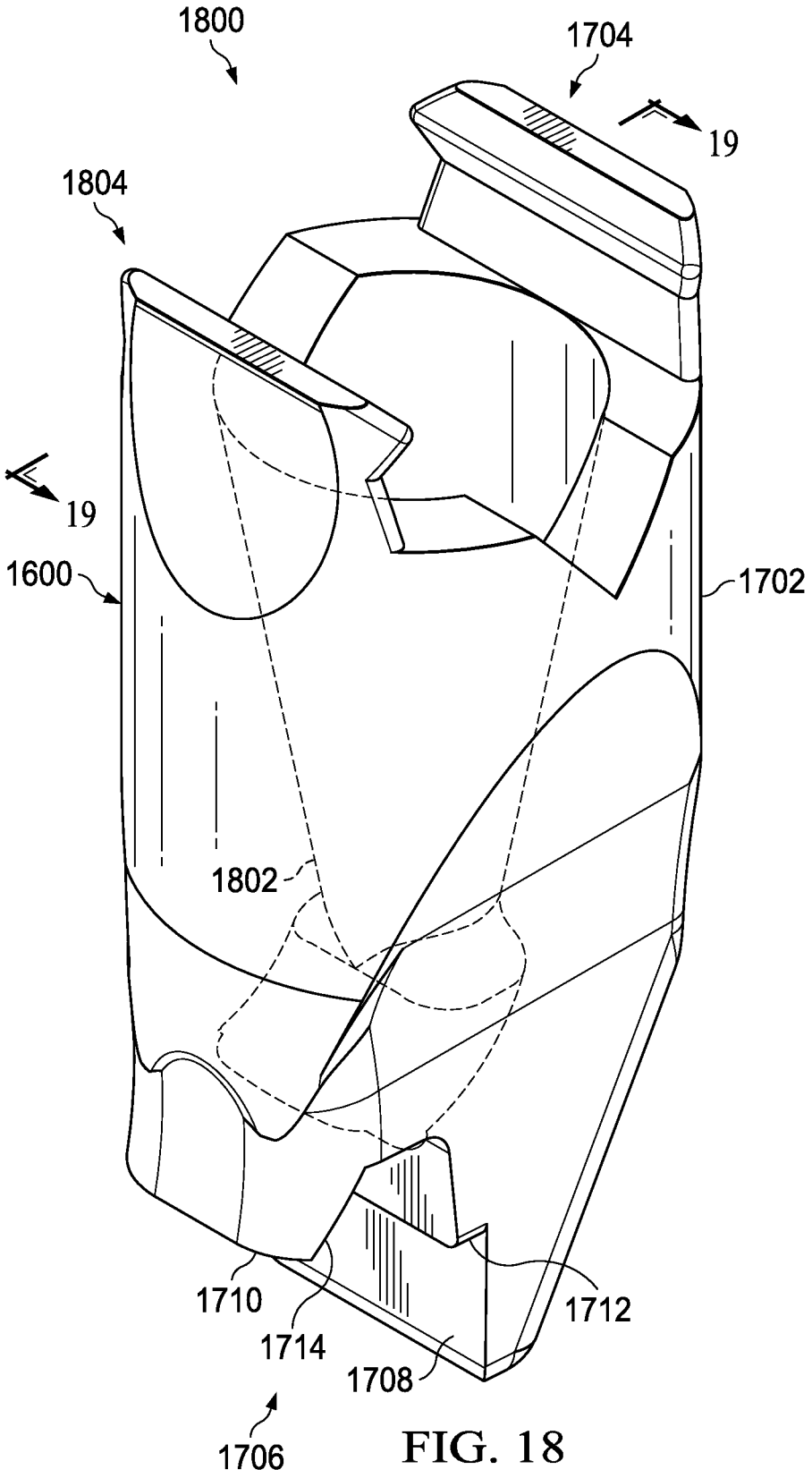
FIG. 18 is an illustration of a transparent view of an application tip in accordance with an illustrative embodiment.

Turning now to FIG. 18, an illustration of a transparent view of an application tip is depicted in accordance with an illustrative embodiment. View 1800 may be an isometric transparent view of application tip 1600 of FIGS. 16 and 17.

Application tip 1600 may include channel 1802. Channel 1802 may extend from first end 1704 to second end 1706. First end 1704 may include number of connections 1804. Number of connections 1804 may connect application tip 1600 to a tool such as tool 204 of FIG. 2.

Figure 19:
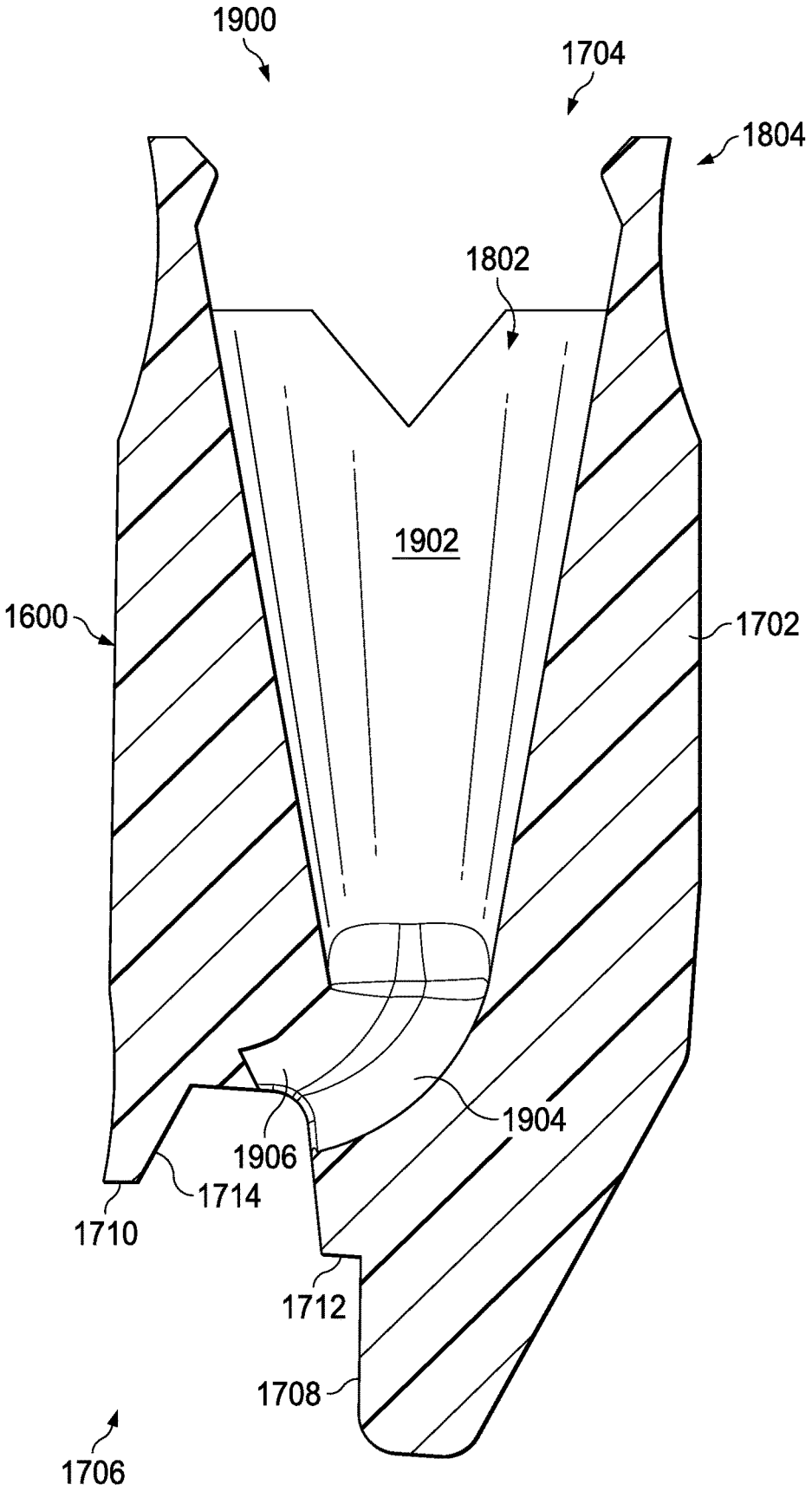
FIG. 19 is an illustration of a cross-sectional view of an application tip in accordance with an illustrative embodiment.

Turning now to FIG. 19, an illustration of a cross-sectional view of an application tip is depicted in accordance with an illustrative embodiment. View 1900 may be a cross-sectional view of application tip 1600 of FIGS. 16-18. View 1900 may be a cross-sectional view of application tip 1600 from direction 19 of FIG. 18. As depicted, channel 1802 of application tip 1600 may have conical portion 1902. Conical portion 1902 may interface with a nozzle of a tool such as nozzle 218 of tool 204 of FIG. 2. Channel 1802 may also include curved portion 1904. Curved portion 1904 may connect conical portion 1902 to exit 1906. Curved portion 1904 may be designed based on at least one of desired location of exit 1906 or desired placement of conical portion 1902.

Shape of channel 1802, including conical portion 1902 and curved portion 1904, may be configured to promote transport of a liquid with a desired viscosity. For example, shape of channel 1802, including conical portion 1902 and curved portion 1904, may be configured to promote transport of a desired sealant. In some examples, shape of channel 1802, including conical portion 1902 and curved portion 1904, may be configured based on a desired flow rate of the sealant. For example, reduction of cross-sectional shape from conical portion 1902 to exit 1906 may increase the pressure of sealant in exit 1906 relative to the remainder of channel 1802 including conical portion 1902.

Figure 20:
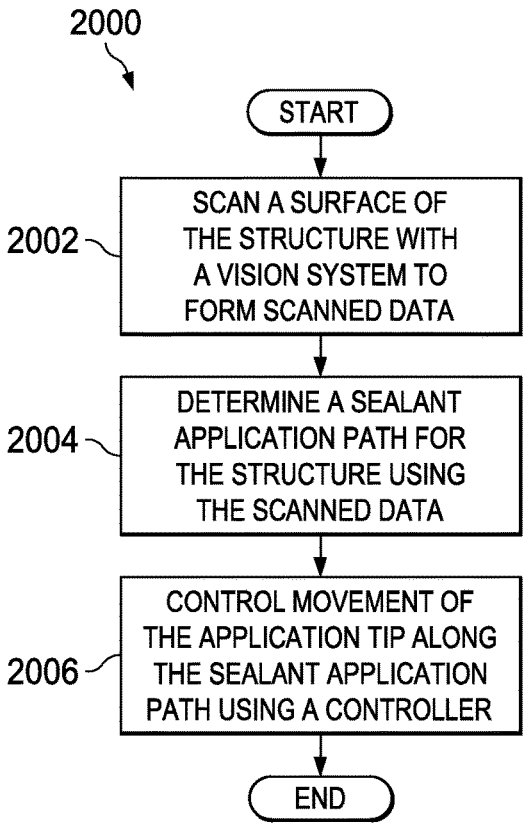
FIG. 20 is an illustration of a flowchart of a process for applying a sealant to a structure in accordance with an illustrative embodiment.

Turning now to FIG. 20, an illustration of a flowchart of a process for designing an application tip is depicted in accordance with an illustrative embodiment. Process 2000 may be used to apply a sealant to a structure. Process 2000 may be a process for applying sealant 214 to structure 202 of FIG. 2. Process 2000 may be utilized to apply at least one of sealant 404, sealant 904, sealant 1204, or sealant 1604.

Process 2000 may scan a surface of the structure with a vision system to form scanned data (operation 2002). Scanning the structure may be performed using a vision system. The scanned data may comprise positional data for the structure.

Process 2000 may also determine a sealant application path for the structure using the scanned data (operation 2004). The sealant application path may be formed by modifying an approximate path based on differences between design dimensions and scanned data 284.

Process 2000 may also control movement of an application tip along the sealant application path using a controller (operation 2006). Afterwards, the process terminates. In some illustrative examples, a forming surface of the application tip forms an exterior shape of the sealant as the application tip is moved along the sealant application path. Thus, the application tip may shape the sealant as the application tip is moved along the sealant application path.

In some illustrative examples, controlling movement of the application tip along the sealant application path using the controller includes moving the application tip such that a sealant surface of the application tip maintains contact with the structure as the application tip moves along the sealant application path. In some illustrative examples, controlling movement of the application tip along the sealant application path using the controller includes moving the application tip such that a guide surface of the application tip contacts a second surface of the structure. In some illustrative examples, controlling movement of the application tip along the sealant application path using the controller comprises controlling a leading angle of the application tip relative to a normal axis of the structure. In some illustrative examples, controlling movement of the application tip along the sealant application path using the controller comprises controlling a tilt angle of the application tip relative to a surface of the structure.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

For example, process 2000 may further flow sealant through the application tip while controlling movement of the application tip along the sealant application path. A volumetric flow of the sealant through the application tip may be controlled by the controller.

In one illustrative example, process 2000 may further inspect the exterior shape of the sealant after forming. In some illustrative examples, process 2000 may further inspect the sealant to form inspection data after forming the exterior shape of the sealant and determine if the sealant is within tolerance based on the inspection data.

In some illustrative examples, process 2000 may position a nozzle of a tool having a sealant source relative to an application tip using the controller, and connect the application tip to the nozzle of the tool using a number of connections of a first end of the application tip. In some illustrative examples, process 2000 may select the application tip based on at least one of the sealant application path or an identity of the structure. In some illustrative examples, process 2000 may determine a number of complex geometries that impinge on the sealant application path, and select the application tip based on the number of complex geometries that impinge on the sealant application path.

Figure 21:
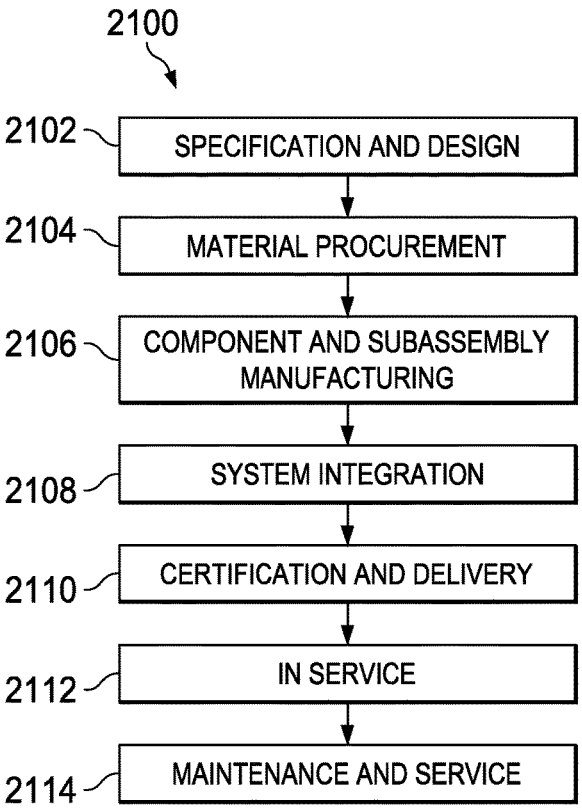
FIG. 21 is an illustration of an aircraft manufacturing and service method in the form of a block diagram in accordance with an illustrative embodiment.
Figure 22:
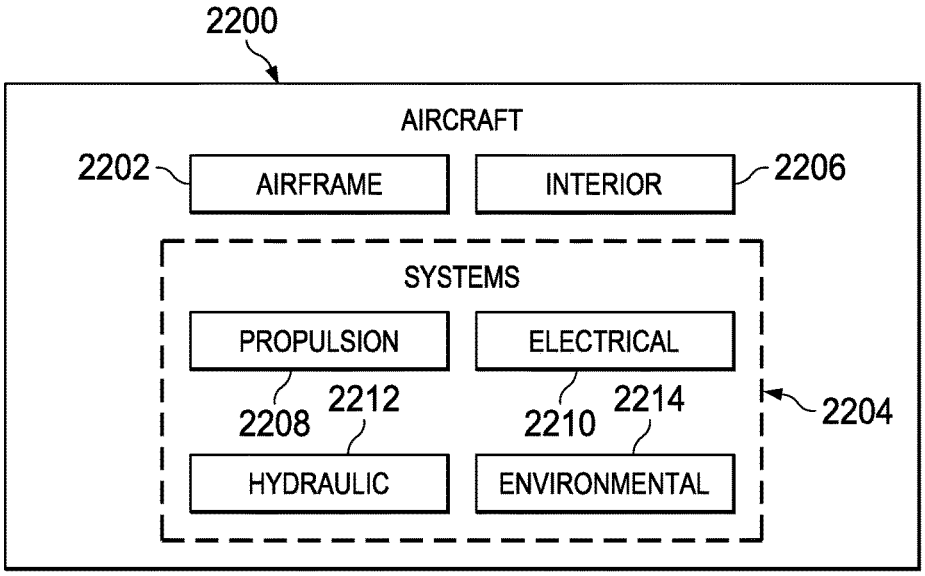
FIG. 22 is an illustration of an aircraft in the form of a block diagram in which an illustrative embodiment may be implemented.

The illustrative embodiments of the present disclosure may be described in the context of aircraft manufacturing and service method 2100 as shown in FIG. 21 and aircraft 2200 as shown in FIG. 22. Turning first to FIG. 21, an illustration of an aircraft manufacturing and service method is depicted in the form of a block diagram in accordance with an illustrative embodiment. During pre-production, aircraft manufacturing and service method 2100 may include specification and design 2102 of aircraft 2200 of FIG. 22 and material procurement 2104.

During production, component and subassembly manufacturing 2106 and system integration 2108 of aircraft 2200 of FIG. 22 takes place. Thereafter, aircraft 2200 of FIG. 22 may go through certification and delivery 2110 in order to be placed in service 2112. While in service 2112 by a customer, aircraft 2200 of FIG. 22 is scheduled for routine maintenance and service 2114, which may include modification, reconfiguration, refurbishment, and other maintenance or service.

Each of the processes of aircraft manufacturing and service method 2100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 22, an illustration of an aircraft is depicted in the form of a block diagram in which an illustrative embodiment may be implemented. In this example, aircraft 2200 is produced by aircraft manufacturing and service method 2100 of FIG. 21 and may include airframe 2202 with systems 2204 and interior 2206. Examples of systems 2204 include one or more of propulsion system 2208, electrical system 2210, hydraulic system 2212, and environmental system 2214. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 2100 of FIG. 21. One or more illustrative embodiments may be used during component and subassembly manufacturing 2106. For example, sealant may be applied by application tip 206 of FIG. 2 during component and subassembly manufacturing 2106. In some examples, sealant may be applied by application tip 206 of FIG. 2 during maintenance and service 2114.

Thus the illustrative embodiments provide a method and apparatus for applying sealant to a structure. Application tip 206 of FIG. 2 may be used to apply sealant to a joint in a structure. Using application tip 206 of FIG. 2 may reduce or eliminate masking steps in producing a structure. By reducing or eliminating masking steps, the use of application tip 206 may reduce the time of manufacturing the structure. Further, the use of application tip 206 to apply sealant may reduce the involvement of human operators in forming seals. By reducing the involvement of human operators, the amount of labor to apply seals to a structure may be reduced. By reducing the involvement of human operators, manufacturing time for the seals may be reduced. Further, by forming seals using application tip 206 of FIG. 2, the shape of the resulting seal may be repeatable. Sealant 214 deposited by application tip 206 may have a higher quality pass rate for shape than sealants formed by hand by human operators. As a result of having a higher quality pass rate, rework or discarded seals may be reduced. Application tip 206 may reduce manufacturing cost by reducing at least one of manufacturing time, labor costs, labor times, or rework quantity.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method of applying a sealant to a structure comprising:

scanning a surface of the structure with a vision system to form scanned data;

determining a sealant application path for the structure using the scanned data;

positioning a nozzle of a tool having a sealant source relative to an application tip with a controller;

connecting the application tip to the nozzle of the tool with a number of connections of a first end of the application tip, wherein the connections comprise opposite facing tabs extending from the first end of the application tip away from a second end of the application tip and toward the nozzle of the tool with inward protrusions formed on the opposite facing tabs that interface with the nozzle of the tool;

controlling movement of an application tip along the sealant application path with the controller;

delivering the sealant to a surface of the structure from an exit of the application tip along a channel between an entrance of the application tip and the exit, wherein the channel redirects a flow of the sealant from a first direction that is substantially perpendicular to a first horizontal plane at the entrance to a second direction that is substantially oblique to a second horizontal plane at the exit; and wherein delivering the sealant further comprises increasing pressure of the sealant with a desired viscosity with increased pressure at the exit relative to the remainder of the channel by moving the sealant through a conical portion and a varying portion of the channel, wherein a cross-sectional shape of the varying portion is oval shaped at a junction with the conical portion and circular at the exit, wherein the conical portion defines a centerline and the opposite facing tabs extend along the centerline of the conical portion and the inward protrusions protrude toward the centerline.

2. The method of claim 1, wherein the scanned data comprises positional data for the structure.

3. The method of claim 1 further comprising:

flowing the sealant through the application tip while controlling movement of the application tip along the sealant application path.

4. The method of claim 3, wherein a volumetric flow of the sealant through the application tip is controlled by the controller.

5. The method of claim 3, wherein a forming surface of the application tip forms an exterior shape of the sealant as the application tip is moved along the sealant application path.

6. The method of claim 5 further comprising:

inspecting the exterior shape of the sealant after forming.

7. The method of claim 5 further comprising:

inspecting the sealant to form inspection data after forming the exterior shape of the sealant; and determining if the sealant is within tolerance based on the inspection data.

8. The method of claim 1, wherein controlling movement of the application tip along the sealant application path using the controller includes moving the application tip such that a sealant surface of the application tip maintains contact with the structure as the application tip moves along the sealant application path.

9. The method of claim 1, wherein controlling movement of the application tip along the sealant application path using the controller includes moving the application tip such that a guide surface of the application tip contacts a second surface of the structure.

10. The method of claim 1, wherein controlling movement of the application tip along the sealant application path using the controller comprises controlling a leading angle of the application tip relative to a normal axis of the structure.

11. The method of claim 1, wherein controlling movement of the application tip along the sealant application path using the controller comprises controlling a tilt angle of the application tip relative to a normal axis of the structure.

12. The method of claim 1 further comprising:

selecting the application tip based on at least one of the sealant application path or an identity of the structure.

13. The method of claim 1 further comprising:

determining a number of complex geometries that impinge on the sealant application path; and selecting the application tip based on the number of complex geometries that impinge on the sealant application path.

14. A sealing system comprising:

a tool having a nozzle and a sealant source;

a controller that controls movement of the tool and flow of a sealant from the sealant source along a surface of a structure;

an application tip comprising a first end having an entrance and a second end having an exit, wherein the application tip is connected to the nozzle of the tool for receiving the sealant at the entrance and applying the sealant to the structure at the exit, wherein the application tip is connected to the tool by a number of connections comprising opposite facing tabs extending from the first end of the application tip away from the second end of the application tip and toward the nozzle of the tool with inward protrusions formed on the opposite facing tabs that interface with the nozzle of the tool; and a channel between the entrance and the exit that redirects the flow of the sealant from a first direction that is substantially perpendicular to a first horizontal plane at the entrance to a second direction that is substantially oblique to a second horizontal plane at the exit;

wherein the channel comprises a conical portion and a varying portion;

further wherein the varying portion has a cross-sectional shape that is oval shaped at a junction with the conical portion and circular at the exit; and further wherein the conical portion defines a centerline and the opposite facing tabs extend along the centerline of the conical portion and the inward protrusions protrude toward the centerline.

15. The sealing system of claim 14, wherein the application tip comprises a housing with the first end and a second end opposite the first end and the channel extending through the housing from the first end to the second end, in which the second end has at least one of a guide surface, a sealant surface, or a forming surface.

16. The sealing system of claim 15, wherein at least a portion of the second end is rounded.

17. The sealing system of claim 15, wherein the guide surface contacts the surface of the structure as the application tip moves relative to the structure.

18. The sealing system of claim 17, wherein the guide surface is complementary to the surface of the structure.

19. The sealing system of claim 15, wherein the forming surface forms an exterior shape of the sealant as the application tip deposits the sealant.

20. The sealing system of claim 15, wherein the forming surface is a concave surface complementary to a convex surface of the sealant.

21. The sealing system of claim 15, wherein the forming surface is a convex surface complementary to a concave surface of the sealant.

22. The sealing system of claim 15, wherein the sealant surface contacts the surface of the structure as the application tip moves relative to the structure to form a closed cross-section for the sealant between the structure and the application tip.

23. The sealing system of claim 15, wherein the channel has more than one centerline.

24. The sealing system of claim 15, wherein the application tip is formed of a polymeric material.

25. The sealing system of claim 15, wherein the conical portion is complementary to the nozzle of the tool and the channel has a curved portion.

26. The sealing system of claim 14 further comprising:

a movement system configured to move the tool relative to the structure.

27. The sealing system of claim 14 further comprising:

an inspection system configured to inspect the sealant for out tolerance conditions after applying the sealant to the structure.

28. The sealing system of claim 14 further comprising:

an inspection system configured to inspect an exterior shape of the sealant after application of the sealant to the structure.

29. A sealing system comprising:

an application tip, the application tip comprising a housing with a first end and a second end opposite the first end and a channel extending through the housing from the first end to the second end, the first end having a number of connections comprising opposite facing tabs extending from the first end of the application tip away from the second end of the application tip and toward a nozzle of a tool with inward protrusions formed on the opposite facing tabs to interface with the nozzle of the tool, the second end having at least one of a guide surface configured to contact a first surface of a structure as the application tip moves relative to the structure, a sealant surface configured to contact a second surface of the structure as the application tip moves relative to the structure, or a forming surface configured to form an exterior shape of a sealant as the application tip deposits the sealant;

wherein the channel comprises a conical portion and a varying portion, and wherein a cross-sectional shape of the varying portion is oval shaped at a junction with the conical portion and circular at the exit;

wherein the channel redirects a flow of the sealant from a first direction substantially perpendicular to a first horizontal plane at the first end to a second direction at that is substantially oblique to a second horizontal plane at the second end; and a controller that controls movement of the application tip relative to the structure to apply the sealant;

wherein the conical portion defines a centerline and the opposite facing tabs extend along the centerline of the conical portion and the inward protrusions protrude toward the centerline.

30. The sealing system of claim 29, wherein at least a portion of the second end is rounded.

31. The sealing system of claim 29, wherein the forming surface is a concave surface complementary to a convex surface of the sealant.

32. The sealing system of claim 29, wherein the forming surface is a convex surface complementary to a concave surface of the sealant.

33. The sealing system of claim 29, wherein the sealant surface contacts a surface of the structure as the application tip moves relative to the structure to form a closed cross-section for the sealant between the structure and the application tip.

34. The sealing system of claim 29, wherein the channel has more than one centerline.

35. The sealing system of claim 29 further comprising:

a scanning system for scanning a sealant application path on the structure.

36. The sealing system of claim 29 further comprising:

a scanning system for scanning a portion of the structure to form scanned data.

37. A sealing system comprising:

a tool having a nozzle and a sealant source;

a controller configured to control movement of the tool and flow of a sealant from the sealant source along a surface of a structure;

an application tip comprising a first end having an entrance and a second end having an exit, wherein the application tip is connected to the nozzle of the tool for receiving the sealant at the entrance and applying the sealant to the structure at the exit, wherein the application tip is connected to the tool by opposite facing tabs extending from a first end of the application tip away from the second end and toward the nozzle of the tool with inward protrusions formed on the opposite facing tabs that interface with the nozzle of the tool; and a channel between the entrance and the exit that comprises a conical portion and a varying portion, wherein the varying portion has a cross-sectional shape that is oval shaped at a junction with the conical portion and circular at the exit and wherein the varying portion redirects the flow of the sealant from a first direction through the conical portion that is substantially perpendicular to a first plane at the entrance to a second direction that is substantially oblique to a second plane at the exit, the second plane parallel to the first plane;

wherein the conical portion defines a centerline and the opposite facing tabs extend along the centerline of the conical portion and the inward protrusions protrude toward the centerline.

38. The sealing system of claim 37, wherein the exit is at a rounded end of the application tip.

39. The sealing system of claim 37, further comprising a forming surface of the application tip configured to form an exterior shape of the sealant as the application tip is moved along the surface of a structure.

* * * * *